US011401617B2

(12) United States Patent
Park et al.

(10) Patent No.: US 11,401,617 B2
(45) Date of Patent: Aug. 2, 2022

(54) MOLTEN SALT ELECTROREFINER

(71) Applicant: KOREA INSTITUTE OF INDUSTRIAL TECHNOLOGY, Cheonan-si (KR)

(72) Inventors: Kyoung-Tae Park, Incheon (KR); Taek-Soo Kim, Incheon (KR); Sang-Hoon Choi, Incheon (KR); Hyun-Gyu Lee, Goyang-si (KR); Jae-Jin Sim, Incheon (KR); Jae-Hong Lim, Seongnam-si (KR)

(73) Assignee: KOREA INSTITUTE OF INDUSTRIAL TECHNOLOGY, Chungcheongnam-Do (KR)

( * ) Notice: Subject to any disclaimer, the term of this patent is extended or adjusted under 35 U.S.C. 154(b) by 0 days.

(21) Appl. No.: 16/767,591

(22) PCT Filed: Nov. 28, 2018

(86) PCT No.: PCT/KR2018/014817
§ 371 (c)(1),
(2) Date: May 28, 2020

(87) PCT Pub. No.: WO2019/107915
PCT Pub. Date: Jun. 6, 2019

(65) Prior Publication Data

US 2020/0385880 A1 Dec. 10, 2020

(30) Foreign Application Priority Data

Nov. 29, 2017 (KR) ..... 10-2017-0162132
May 11, 2018 (KR) ..... 10-2018-0054372

(51) Int. Cl.
*C25C 3/00* (2006.01)
*C25C 7/00* (2006.01)
(Continued)

(52) U.S. Cl.
CPC ..... *C25C 7/005* (2013.01); *C25C 3/34* (2013.01); *C25C 7/06* (2013.01)

(58) Field of Classification Search
CPC .. C25C 3/00; C25C 7/005; C25C 3/34; C25C 7/025; C25C 5/04; C25C 3/08;
(Continued)

(56) References Cited

U.S. PATENT DOCUMENTS 4,851,089 A 7/1989 Honders et al.
9,039,885 B1 * 5/2015 Holland ..... C25C 3/34 205/359

FOREIGN PATENT DOCUMENTS

JP 02101186 A 4/1990
KR 1020030046669 A 6/2003
(Continued)

OTHER PUBLICATIONS

International Search Report dated Apr. 3, 2019 for PCT/KR2018/014817.
(Continued)

*Primary Examiner* — Zulmariam Mendez
(74) *Attorney, Agent, or Firm* — Cantor Colburn LLP

(57) ABSTRACT

The present invention provides a molten-salt electrolytic refining apparatus for refining a raw-material alloy containing indium using a molten-salt electrolytic refining method. The molten-salt electrolytic refining apparatus includes a reaction crucible provided in a reaction container so as to be filled with a molten-salt electrolytic solution, an anode and a cathode immersed in the molten-salt electrolytic solution, an anode crucible in which a liquid raw-material alloy is contained, a cathode crucible in which at least one raw-material metal included in the raw-material alloy is recovered in a liquid phase, and a heater provided so that the temperature of the molten-salt electrolytic solution is
(Continued)

adjusted to be equal to or greater than the melting temperature of the raw-material alloy. The present invention also provides a molten-salt electrolytic refining method which includes recovering indium (In) from an indium-tin (In—Sn) alloy using a molten-salt electrolytic solution containing fluoride.

11 Claims, 19 Drawing Sheets

(51) Int. Cl.
*C25C 3/34* (2006.01)
*C25C 7/06* (2006.01)

(58) Field of Classification Search
CPC .. C25C 7/00; C25C 7/02; C25C 7/007; C25C 3/10; C25C 3/18
See application file for complete search history.

(56) References Cited

FOREIGN PATENT DOCUMENTS

| | | | |
|---|---|---|---|
| KR | 100614890 | B1 | 8/2006 |
| KR | 101012109 | B1 | 2/2011 |
| KR | 1020130078196 | A | 7/2013 |
| KR | 101298072 | B1 | 8/2013 |
| KR | 1020160116429 | A | 10/2016 |
| KR | 101719307 | B1 | 3/2017 |

OTHER PUBLICATIONS

Korean Notice of Allowance for Application No. 10-2017-0162132 dated May 15, 2019.
Korean Notice of Allowance for Application No. 10-2018-0054372 dated Apr. 14, 2020.

* cited by examiner

Fig. 12

| | $T_m$[K] | A | B | C | D |
|---|---|---|---|---|---|
| Cd | 594 | 5.242 | -5392 | 0 | 0 |
| Zn | 692 | 5.378 | -6286 | 0 | 0 |
| Tl | 577 | 5.259 | -9037 | 0 | 0 |
| Pb | 601 | 4.911 | -9701 | 0 | 0 |
| In | 429 | 5.374 | -12276 | 0 | 0 |
| Sn | 508 | 5.262 | -15332 | 0 | 0 |

MOLTEN SALT ELECTROREFINER

TECHNICAL FIELD

The present invention relates to a molten-salt electrolytic refining apparatus and to a refining method of refining a raw-material alloy containing indium using a molten-salt electrolytic refining method to thus effectively recover high-purity indium.

BACKGROUND ART

As is well known in the art, various metal oxide semiconductor elements have come to be used in display devices according to the development of various electronic devices. Having high transmittance and excellent electrical properties, a transparent conductive oxide (TCO) semiconductor is frequently used as a transparent electrode material of a display device.

For example, transparent high-performance conductors such as ITO (Indium-Tin-Oxide) are widely used in transparent electrode materials. Valuable metals used as metal oxide materials such as ITO have high value and thus have high value when recycled from waste of electronic devices or display devices mentioned above or byproducts from the manufacturing process thereof.

For this reason, it is necessary to secure techniques for recovering, refining, and recycling valuable metals, such as indium, from waste scraps containing valuable metals, for example, ITO waste scraps. Through these techniques, it is possible to obtain effects of reducing raw-material costs and resource consumption.

Indium, which is a precious metal, is a rare metal contained in a small amount in byproducts of zinc refining, and is well known as an expensive metal. Indium oxide ($In_2O_3$) may be provided as a transparent high-performance conductor (ITO: Indium-Tin-Oxide) when tin oxide ($SnO_2$) is added thereto. This ITO material is frequently used as a transparent conductive film due to the properties thereof. Obtaining indium is considered as an important factor in determining the luck of the ITO industry, and indium is used in bonding materials, semiconductor elements, battery materials, and bearings. Accordingly, the demand therefor continues to increase.

Indium, as described above, is conventionally recovered using various methods, such as solvent extraction, stripping, cementation, coagulation molding (briquetting), anode casting, electrolytic refining, and casting. However, most of these processes have problems in that complicated processes must be performed and in that environmental problems result due to the use of large amounts of acids.

There is another problem in that a molten salt containing indium chloride is denatured due to a chemical reaction when the molten salt comes into contact with air, thereby deteriorating the quality of indium. Even when indium is recovered using electrolytic refining, there is a problem in indium recoverability and industrial applicability due to the problem of reactivity with crucibles and electrodes.

PRIOR ART DOCUMENT (Patent Document 1) 1. Korean Patent No. 10-0614890 (Registered on Aug. 16, 2006)

(Patent Document 2) 2. Korean Patent No. 10-1012109 (Registered on Jan. 25, 2011)

DISCLOSURE

Technical Problem

An object of the present invention is to provide a molten-salt electrolytic refining apparatus for refining a raw-material alloy containing indium using a molten-salt electrolytic refining method to thus effectively recover high-purity indium. The molten-salt electrolytic refining apparatus includes a reaction crucible provided in a reaction container so as to be filled with a molten-salt electrolytic solution, and an anode crucible, in which the raw-material alloy is contained, and a cathode crucible, in which a raw-material metal is precipitated, provided in the reaction crucible.

Another object of the present invention is to provide a molten-salt electrolytic refining apparatus in which a liquid raw-material alloy is continuously supplied through the hollow portion of an anode during an electrolytic refining process, and the raw-material alloy is continuously recovered in a cathode crucible while unreacted alloy is discharged from an anode crucible, whereby a continuous electrolytic refining process is performed, thus effectively improving the process yield and productivity.

Another object of the present invention is to provide a molten-salt electrolytic refining method which includes adjusting the temperature of a molten-salt electrolytic solution to be equal to or greater than the melting temperature of a raw-material alloy using a heater provided between a reaction container and a reaction crucible, and applying an electric current to an anode and a cathode, thus performing an electrolytic refining process, whereby the raw-material alloy containing indium is refined using molten-salt electrolytic refining to thus effectively recover high-purity indium.

Another object of the present invention is to provide a molten-salt electrolytic refining method which includes performing an electrolytic refining process using a fluoride containing lithium fluoride (LiF) and potassium fluoride (KF) as a molten-salt electrolytic solution, whereby thermodynamic stability and reactivity are improved, thus effectively recovering high-purity indium.

Another object of the present invention is to provide a molten-salt electrolytic refining method in which a liquid raw-material alloy is continuously supplied through the hollow portion of an anode during an electrolytic refining process, and the raw-material alloy is continuously recovered in a cathode crucible while unreacted alloy is discharged from an anode crucible, whereby a continuous electrolytic refining process is performed, thus effectively improving the process yield and productivity.

The objects of the embodiments of the present invention are not limited to the above-mentioned objects, and other objects that are not mentioned will be clearly understood by those skilled in the art from the following description.

Technical Solution

According to an embodiment of the present invention, the present invention may provide a molten-salt electrolytic refining apparatus. The molten-salt electrolytic refining apparatus includes a reaction container having a hollow portion therein and an upper cover provided at an opened top portion thereof to be sealed, a reaction crucible provided in the reaction container so as to be filled with a molten-salt electrolytic solution, an anode and a cathode immersed in the molten-salt electrolytic solution, an anode crucible in which a raw-material alloy is contained so that the lower end of the anode is immersed in the liquid raw-material alloy to be refined, a cathode crucible in which the lower end of the cathode is positioned so that at least one raw-material metal included in the raw-material alloy is recovered in a liquid phase through an electrolytic refining process, and a heater provided between the reaction container and the reaction crucible so that the temperature of the molten-salt electrolytic solution is adjusted to be equal to or greater than the melting temperature of the raw-material alloy.

Further, according to an embodiment of the present invention, the present invention may provide a molten-salt electrolytic refining apparatus further including a holding plate on which the reaction crucible is seated.

Further, according to an embodiment of the present invention, the present invention may provide a molten-salt electrolytic refining apparatus, wherein an electrolytic refining process is performed when the holding plate is moved upwards so as to bring a molten-salt electrolytic solution into contact with an anode and a cathode, and the electrolytic refining process is stopped when the holding plate is moved downwards so as to enable the molten-salt electrolytic solution to be spaced apart from the anode and the cathode.

Further, according to an embodiment of the present invention, the present invention may provide a molten-salt electrolytic refining apparatus, wherein an electrolytic refining process is performed when an anode and a cathode are moved downwards so as to be brought into contact with a molten-salt electrolytic solution, and the electrolytic refining process is stopped when the anode and the cathode are moved upwards so as to be spaced apart from the molten-salt electrolytic solution.

Further, according to an embodiment of the present invention, the present invention may provide a molten-salt electrolytic refining apparatus, wherein the anode includes a hollow portion therein, and the raw-material metal is continuously supplied in a liquid phase through the hollow portion to the anode crucible.

Further, according to an embodiment of the present invention, the present invention may provide a molten-salt electrolytic refining apparatus which further includes a discharge unit for discharging unreacted alloy remaining in the anode crucible and a recovery unit for recovering the raw-material metal from the cathode crucible.

Further, according to an embodiment of the present invention, the present invention may provide a molten-salt electrolytic refining apparatus wherein an indium-tin (In—Sn) alloy is charged as the raw-material alloy and indium (In) is recovered as the raw-material metal.

Further, according to an embodiment of the present invention, the present invention may provide a molten-salt electrolytic refining method which includes recovering indium (In) from an indium-tin (In—Sn) alloy using a molten-salt electrolytic solution containing a fluoride.

Further, according to an embodiment of the present invention, the present invention may provide a molten-salt electrolytic refining method wherein the fluoride includes lithium fluoride (LiF) and potassium fluoride (KF).

Further, according to an embodiment of the present invention, the present invention may provide a molten-salt electrolytic refining method which includes filling a reaction crucible provided in a reaction container with the molten-salt electrolytic solution, immersing an anode and a cathode in the molten-salt electrolytic solution, immersing the lower end of the anode in an anode crucible in which the liquid indium-tin (In—Sn) alloy is contained, and disposing a cathode crucible in which the lower end of the cathode is positioned, adjusting the temperature of the molten-salt electrolytic solution to be equal to or greater than the melting temperature of the indium-tin (In—Sn) alloy using a heater provided between the reaction container and the reaction crucible, applying an electric current to the anode and cathode, thus performing an electrolytic refining process, and recovering the indium (In) from the cathode crucible using the electrolytic refining process.

Further, according to an embodiment of the present invention, the present invention may provide a molten-salt electrolytic refining method wherein the indium-tin (In—Sn) alloy is continuously supplied through a hollow portion in the anode to the anode crucible.

Further, according to an embodiment of the present invention, the present invention may provide a molten-salt electrolytic refining method wherein the molten-salt electrolytic refining method is continuously performed in such a way that the indium (In) is recovered from the cathode crucible while unreacted alloy remaining in the anode crucible is discharged.

Further, according to an embodiment of the present invention, the present invention may provide a molten-salt electrolytic refining method which further includes performing a vacuum distillation process on the recovered indium (In).

Further, according to an embodiment of the present invention, the present invention may provide a molten-salt electrolytic refining method wherein the performing the vacuum distillation process includes a first step of removing at least one impurity having a saturation vapor pressure that is relatively higher than a saturation vapor pressure of the indium (In) using a first vacuum distillation process in a predetermined temperature range, and a second step of volatilizing the indium (In) using a second vacuum distillation process in a temperature range relatively higher than in the first step, thus recovering high-purity indium (In).

Advantageous Effects

In the present invention, a reaction crucible is provided in a reaction container so as to be filled with a molten-salt electrolytic solution, and an anode crucible, in which a raw-material alloy is contained, and a cathode crucible, in which a raw-material metal is precipitated, are provided in the reaction crucible. Thereby, it is possible to refine a raw-material alloy containing indium using a molten-salt electrolytic refining method to thus effectively recover high-purity indium.

Further, the liquid raw-material alloy is continuously supplied through the hollow portion of an anode during an electrolytic refining process, and the raw-material alloy is continuously recovered in the cathode crucible while unreacted alloy is discharged from the anode crucible. Thereby, it is possible to perform a continuous electrolytic refining process to thus effectively improve the process yield and productivity.

In the present invention, the temperature of the molten-salt electrolytic solution is adjusted to be equal to or greater than the melting temperature of the raw-material alloy using a heater provided between the reaction container and the reaction crucible, and an electric current is applied to the anode and the cathode, thus performing an electrolytic refining process. Thereby, it is possible to refine the raw-material alloy containing indium using a molten-salt electrolytic refining method to thus effectively recover high-purity indium.

Further, in the present invention, the electrolytic refining process is performed using a fluoride containing lithium fluoride (LiF) and potassium fluoride (KF) as the molten-salt electrolytic solution. Thereby, it is possible to improve thermodynamic stability and reactivity, thus effectively recovering high-purity indium.

DESCRIPTION OF DRAWINGS

FIGS. 12, 13, and 14 to 16 are views for explaining a vacuum distillation process that is additionally applied to a molten-salt electrolytic refining method according to an embodiment of the present invention.

BEST MODE

Figure 1:
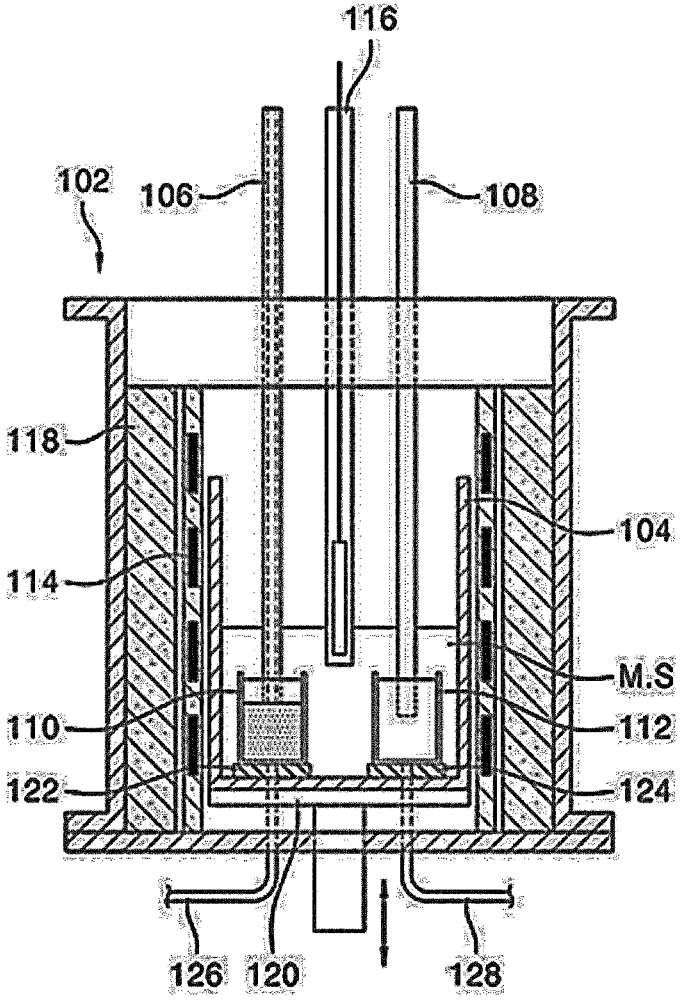
FIG. 1 is a view illustrating a molten-salt electrolytic refining apparatus according to an embodiment of the present invention.

Advantages and features of embodiments of the present invention, and methods for achieving the same, will be clarified from the embodiments described below in detail together with the accompanying drawings. However, the present invention is not limited to the embodiments disclosed below, but may be implemented in various different forms. The present embodiments are provided to make the disclosure of the present invention complete, and to fully disclose the scope of the invention to those skilled in the art to which the present invention pertains, and the present invention is only defined by the scope of the claims. The same reference numerals refer to the same components throughout the specification.

In describing embodiments of the present invention, when it is determined that a detailed description of known functions or configurations may unnecessarily obscure the subject matter of the present invention, the detailed description thereof will be omitted. In addition, terms to be described later are terms defined in consideration of functions in an embodiment of the present invention, which may vary depending on a user's or operator's intention or practice. Therefore, the definition should be made based on the contents throughout this specification.

Hereinafter, embodiments of the present invention will be described in detail with reference to the accompanying drawings.

<Molten-Salt Electrolytic Refining Apparatus>

FIG. 1 is a view illustrating a molten-salt electrolytic refining apparatus according to an embodiment of the present invention.

Referring to FIG. 1, the molten-salt electrolytic refining apparatus according to the embodiment of the present invention may include a reaction container 102, a reaction crucible 104, an anode 106, a cathode 108, an anode crucible 110, a cathode crucible 112, a heater 114, a reference electrode 116, a heat-blocking material 118, a holding plate 120, a first support plate 122, a second support plate 124, a discharge unit 126, and a recovery unit 128.

The reaction container 102 has a hollow portion therein and an upper cover provided at an opened top portion thereof to be sealed. An electrolytic refining process may be performed using the components provided in the sealed space.

With regard to the reaction container 102, the amounts of $O_2$ and $H_2O$ may be controlled so as to be approximately 10 ppm or less in an internal space thereof in which a molten-salt electrolytic refining process is performed. Accordingly, the electrolytic refining process may be performed in a molten salt atmosphere at high temperatures as well as low temperatures, and the movement of each crucible, the movement of the upper cover, and the rotation of the electrode may be controlled using a remote control method from the outside.

In addition, the reaction container 102 may be manufactured using stainless steel so as to have a diameter of about 33.5 cm and a height of about 35 cm. An insulating material and a water-cooling chamber may be installed on the outside of the reaction container 102. The anode 106 and the cathode 108 may be used in combination using a bolt so as to be formed through the upper cover. The reference electrode 116 may be fixed using a stopper.

The reaction crucible 104 may be provided in the reaction container 102 so as to be filled with a molten-salt electrolytic solution (M.S.: molten salt), and may be manufactured using nickel (Ni). The molten-salt electrolytic solution (M.S.) may include, for example, an alkali metal halide, and the alkali metal halide may include, for example, lithium chloride (LiCl) and potassium chloride (KCl). This reaction crucible 104 may be manufactured so as to have a diameter of about 20 cm and a height of about 22.5 cm, and may be manufactured so as to have various sizes as required.

The anode 106 is immersed in the molten-salt electrolytic solution (M.S.), and may be manufactured so as to have a rod shape using at least one selected from among tungsten (W), tantalum (Ta), and molybdenum (Mo). A hollow portion is provided in the anode, and a raw-material metal may be continuously supplied in a liquid phase through the hollow portion to the anode crucible. An indium-tin (In—Sn) alloy may be charged as a raw-material alloy.

The cathode 108 is immersed in the molten-salt electrolytic solution (M.S.), and may be manufactured so as to have a rod shape using at least one selected from among tungsten (W), tantalum (Ta), and molybdenum (Mo).

In the anode crucible 110, the raw-material alloy is contained so that the lower end of the anode 106 is immersed in the liquid raw-material alloy to be refined. The anode crucible 110 may be manufactured using zirconium oxide ($ZrO_2$) or aluminum oxide ($Al_2O_3$). The anode crucible 110 may be manufactured so as to have a diameter of about 6 cm and a height of about 11.5 cm, and may be manufactured so as to have various sizes as required.

In the cathode crucible 112, the lower end of the cathode 108 is positioned so that at least one raw-material metal included in the raw-material alloy is recovered in a liquid phase using an electrolytic refining process. The cathode crucible 112 may be manufactured using zirconium oxide ($ZrO_2$) or aluminum oxide ($Al_2O_3$). Indium (In) may be recovered as the raw-material metal. The cathode crucible 112 may be manufactured so as to have a diameter of about 6 cm and a height of about 11.5 cm, and may be manufactured so as to have various sizes as required.

The heater 114 may be provided between the reaction container 102 and the reaction crucible 104 so that the temperature of the molten-salt electrolytic solution (M.S.) is adjusted to be equal to or greater than the melting temperature of the raw-material alloy. The reference electrode 116 may be immersed in the molten-salt electrolytic solution (M.S.) in order to measure the electric potential of the anode 106 and the cathode 108. The heat-blocking material 118 may be provided between the reaction container 102 and the heater 114 in order to block the heat of the heater 114.

The reaction crucible 104 is seated on a holding plate 120. In the case where the holding plate is provided so as to be movable upwards and downwards, when the holding plate 120 is moved upwards so as to bring the molten-salt electrolytic solution (M.S.) into contact with the anode 106 and the cathode 108, the electrolytic refining process may be performed. When the holding plate 120 is moved downwards so as to enable the molten-salt electrolytic solution (M.S.) to be spaced apart from the anode 106 and the cathode 108, the electrolytic refining process may be stopped.

Meanwhile, in the case where the holding plate 120 is provided in a fixed state, when the anode 106 and the cathode 108, coupled to the upper cover of the reaction container 102, are moved downwards so as to be brought into contact with the molten-salt electrolytic solution (M.S.), the electrolytic refining process may be performed. When the anode 106 and the cathode 108 are moved upwards so as to be spaced apart from the molten-salt electrolytic solution (M.S.), the electrolytic refining process may be stopped.

The first support plate 122, which is formed of a ceramic material containing aluminum oxide ($Al_2O_3$), may be provided on the bottom surface of the reaction crucible 104 in order to prevent current from flowing during the molten-salt electrolytic refining process, so that the anode crucible 110 may be seated thereon. The second support plate 124, which is formed of a ceramic material containing aluminum oxide ($Al_2O_3$), may be provided on the bottom surface of the reaction crucible 104 in order to prevent current from flowing during the molten-salt electrolytic refining process, so that the cathode crucible 112 may be seated thereon.

The discharge unit 126 serves to discharge the unreacted alloy remaining in the anode crucible 110. When unreacted alloy remains in the anode crucible 110 during the molten-salt electrolytic refining process using the liquid raw-material alloy, the remaining liquid unreacted alloy may be discharged through the discharge unit 126 provided at the lower portion of the anode crucible 110 to the outside.

This discharge unit 126 may be formed through the anode crucible 110, the first support plate 122, the holding plate 120, and the reaction container 102, and may extend to the outside. The discharge unit 126 may be connected to an unreacted-alloy collection tank (not shown) to effectively collect the liquid unreacted alloy.

The recovery unit 128 serves to recover the raw-material metal from the cathode crucible 112. When the raw-material metal is recovered from the interior of the cathode crucible 112 during the molten-salt electrolytic refining process, the liquid raw-material metal is discharged through the recovery unit 128 provided at the lower portion of the cathode crucible 112. The recovery unit 128 may be formed through the cathode crucible 112, the second support plate 124, the holding plate 120, and the reaction container 102, and may extend to the outside. The recovery unit 128 may be connected to an unreacted-alloy collection tank (not shown) to effectively collect the liquid raw-material metal.

In the molten-salt electrolytic refining apparatus as described above, a separate agitator for agitating the molten-salt electrolytic solution (M.S.) may be provided at the upper cover of the reaction container 102. The molten-salt electrolytic solution (M.S.) may be continuously agitated using the agitator during the electrolytic refining process.

Meanwhile, the process in the molten-salt electrolytic refining apparatus described above will be briefly described. The anode crucible 110 charged with the raw-material alloy may be disposed in the reaction crucible 104 provided in the reaction container 102, and the cathode crucible 112 may be disposed adjacent thereto. After the interior of the reaction crucible 104 is filled with the molten-salt electrolytic solution to a predetermined level, sealing may be performed using the upper cover of the reaction container 102.

In addition, the heater 114 may be operated so that the temperature of the molten-salt electrolytic solution (M.S.) is adjusted to be equal to or greater than the melting temperature of the raw-material alloy charged in the anode crucible 110. The holding plate 120 may be moved upwards so as to immerse the anode 106 and the cathode 108 in the molten-salt electrolytic solution (M.S.), thereby performing the electrolytic refining process. The liquid raw-material metal may be recovered from the cathode crucible 112 using the electrolytic reduction reaction of the liquid raw-material alloy and the molten-salt electrolytic solution (M.S.).

In order to continuously perform the electrolytic refining process using this electrolytic reduction reaction, the raw-material alloy may be continuously supplied in a liquid phase to the interior of the anode 106, and the raw-material metal may be continuously recovered from the cathode crucible 112 through the recovery unit 128 while the unreacted alloy remaining in the anode crucible 110 is continuously discharged through the discharge unit 126.

Therefore, in the present invention, the reaction crucible filled with the molten-salt electrolytic solution in the reaction container may be provided, and the anode crucible, in which the raw-material alloy is contained, and the cathode crucible, in which the raw-material metal is precipitated, may be provided in the reaction crucible, whereby it is possible to refine the raw-material alloy containing indium using the molten-salt electrolytic refining method, thus effectively recovering high-purity indium.

Further, in the present invention, a heater for adjusting the temperature of the molten-salt electrolytic solution filled in the reaction crucible may be provided between the reaction container and the reaction crucible, and a heat-blocking material may be provided between the reaction container and the heater, whereby it is possible to effectively block heat so that the heat of the heater is prevented from being transferred to the reaction container during the recovery of high-purity indium.

Moreover, in the present invention, the support plates, including a ceramic material containing aluminum oxide ($Al_2O_3$), may be provided so as to correspond in position to the anode crucible and the cathode crucible on the inner bottom of the reaction crucible. The anode crucible and the cathode crucible may be seated on the support plates, thereby preventing current from flowing between the reaction crucible, the anode crucible, and the cathode crucible during the recovery of high-purity indium.

Meanwhile, during the electrolytic refining process, the liquid raw-material alloy may be continuously supplied through the hollow portion of the anode, and the raw-material alloy may be continuously recovered from the cathode crucible while the unreacted alloy is discharged from the anode crucible. Accordingly, a continuous electrolytic refining process may be performed, thus effectively improving the process yield and productivity.

Next, thermodynamic stability for optimal material selection of the molten-salt electrolytic solution, the electrode, and the crucible in the molten-salt electrolytic refining apparatus having the above-described constitution will be described.

FIGS. 2A to 2E and FIGS. 3A to 3E are views for explaining the thermodynamic stability for optimal material selection of the electrolytic solution, the electrode, and the crucible applied to the molten-salt electrolytic refining apparatus according to the embodiment of the present invention.

In order to perform the molten-salt electrolytic refining process of In—Sn, eutectic salts of lithium chloride (LiCl) and potassium chloride (KCl), which are alkali metal halides, were selected as an electrolyte composition. Based on this, FactSage6.4 and HSC Chemistry were used to evaluate the thermodynamic stability of the electrolyte/electrode and the crucible material.

Figure 2A:
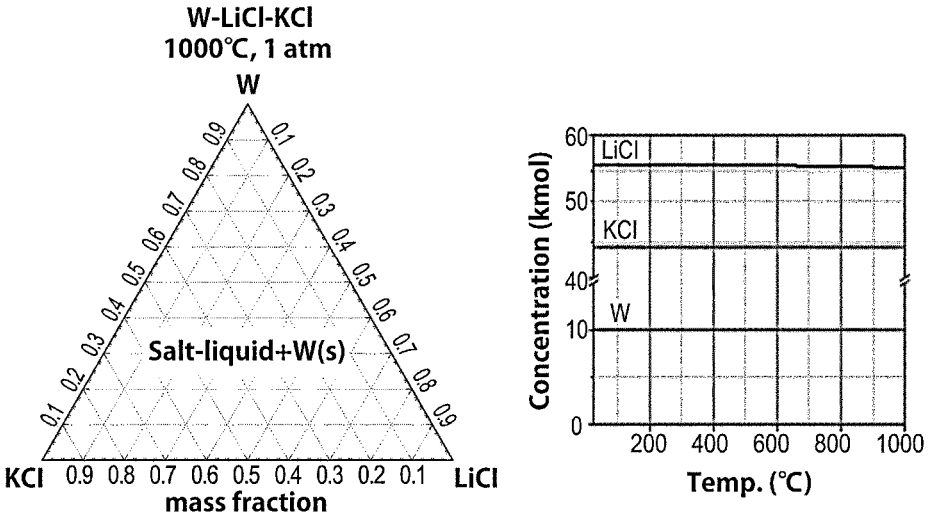
FIGS. 2A to 2E and FIGS. 3A to 3E are views for explaining the thermodynamic stability for optimal material selection of an electrolytic solution, an electrode, and a crucible applied to a molten-salt electrolytic refining apparatus according to an embodiment of the present invention.
Figure 2B:
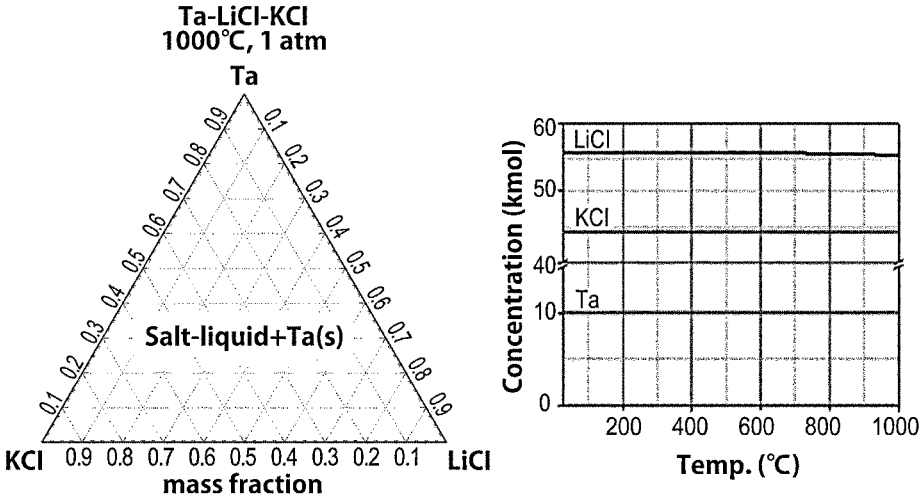
Figure 2C:
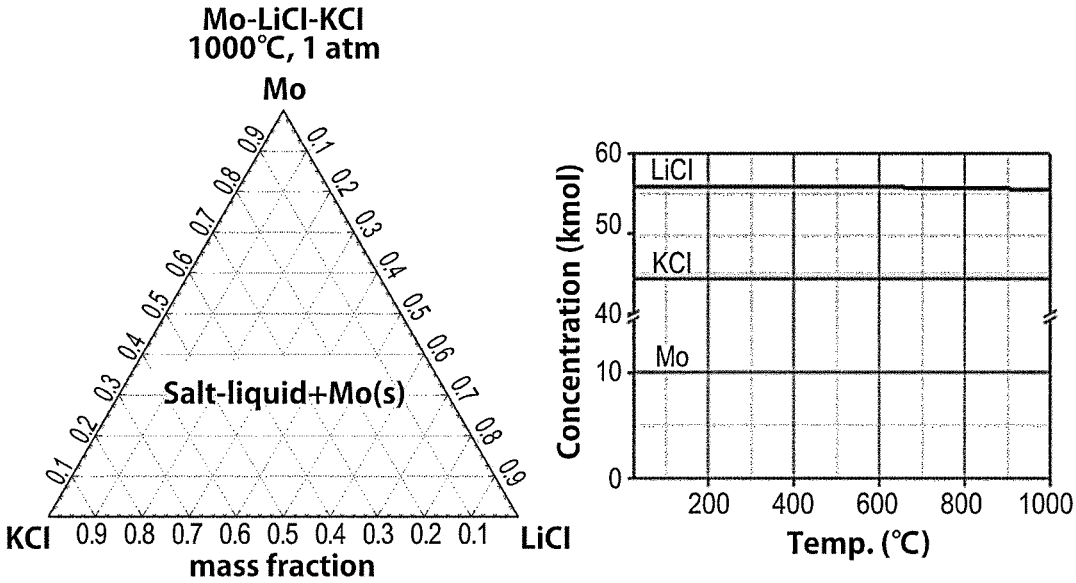

As shown in FIGS. 2A to 2C, all of the selected materials W, Ta, and Mo were confirmed to be thermodynamically stable without reacting with LiCl—KCl eutectic salts. Accordingly, it is judged that all three materials are usable as crucible and electrode materials.

Figure 2D:
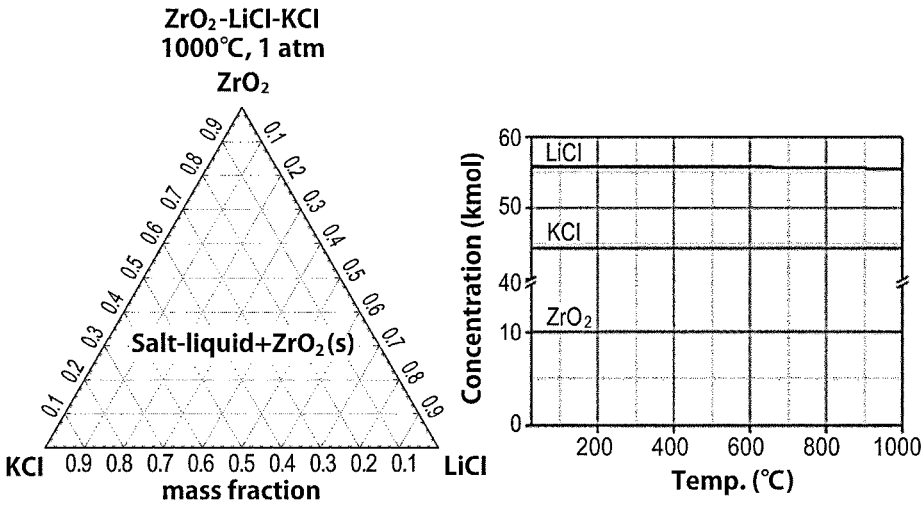
Figure 2E:
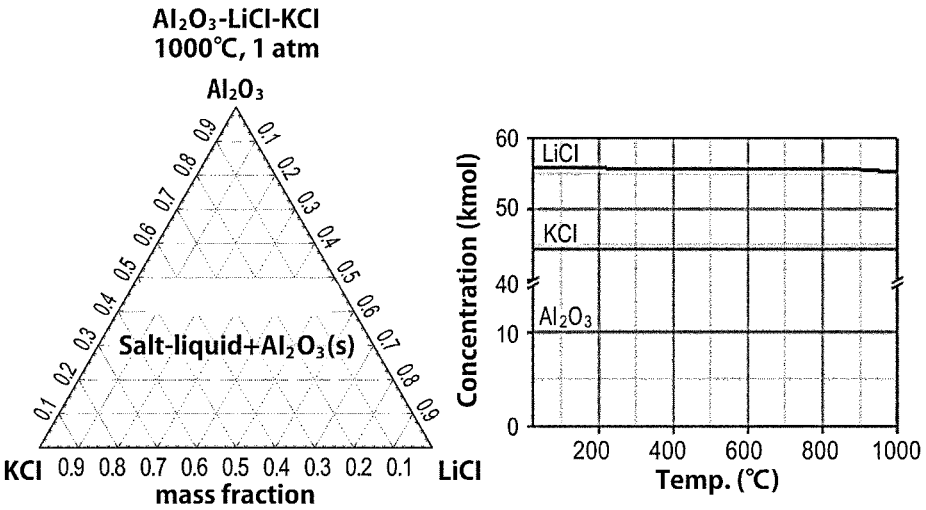

Further, in addition to metallic materials, $ZrO_2$ and $Al_2O_3$ ceramic materials for use in crucibles were also evaluated for stability with LiCl—KCl eutectic salts. As shown in FIGS. 2D and 2E, it was confirmed that the ceramic materials were also stable in the eutectic salts.

Meanwhile, an In—Sn liquid metal may be used in the anode in order to refine pure In. Accordingly, in addition to the eutectic salts, thermodynamic stability evaluation for the anode and cathode materials and the electrode and crucible materials was performed.

Figure 3A:
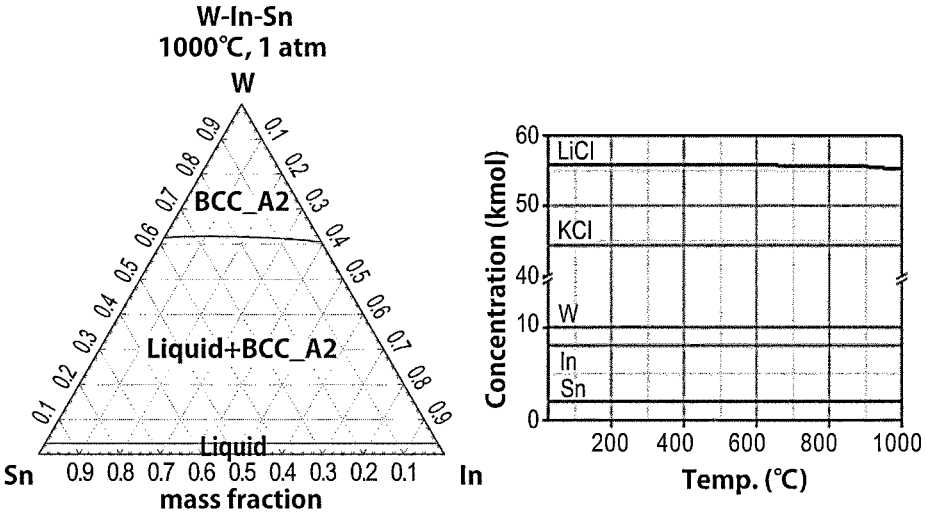
Figure 3B:
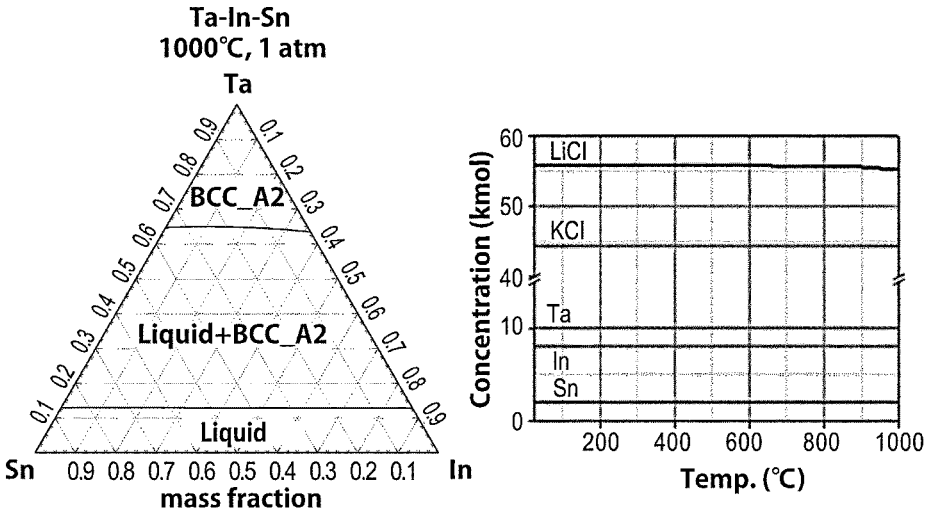
Figure 3C:
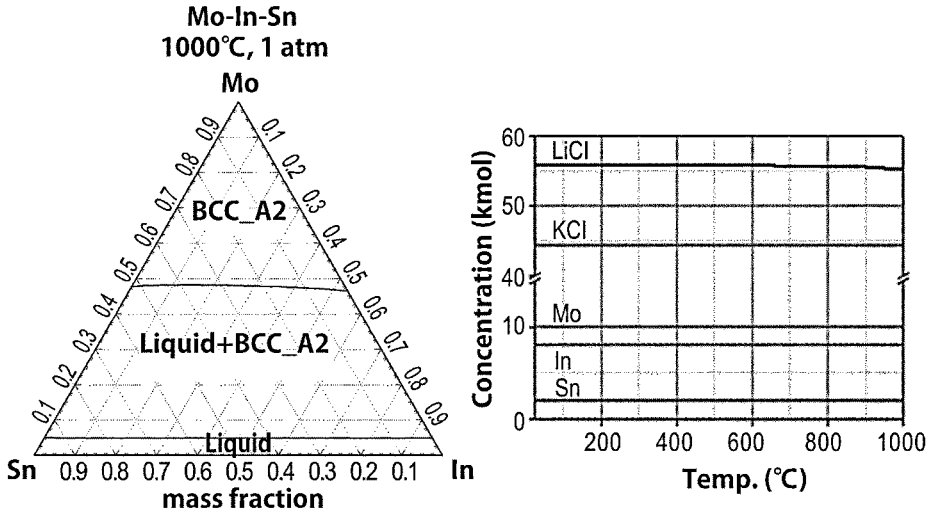

As a result, it can be seen from the FactSage results shown in FIGS. 3A to 3C that a liquid phase is formed at high temperatures depending on the composition in the case of a metal material. This means that the metal material is solid-solved in the liquid In—Sn when the concentration of the metal material is very low in an equilibrium diagram, thus being useful as an electrode material. In the case where the metal material is used in a crucible, it can be seen that thermodynamic stability is secured without other reactions when the concentration of the metal material is high.

In addition, from the HSC Chemistry results, it could be confirmed that the concentration of the product depending on the temperature is stably maintained without any reaction or change.

Figure 3D:
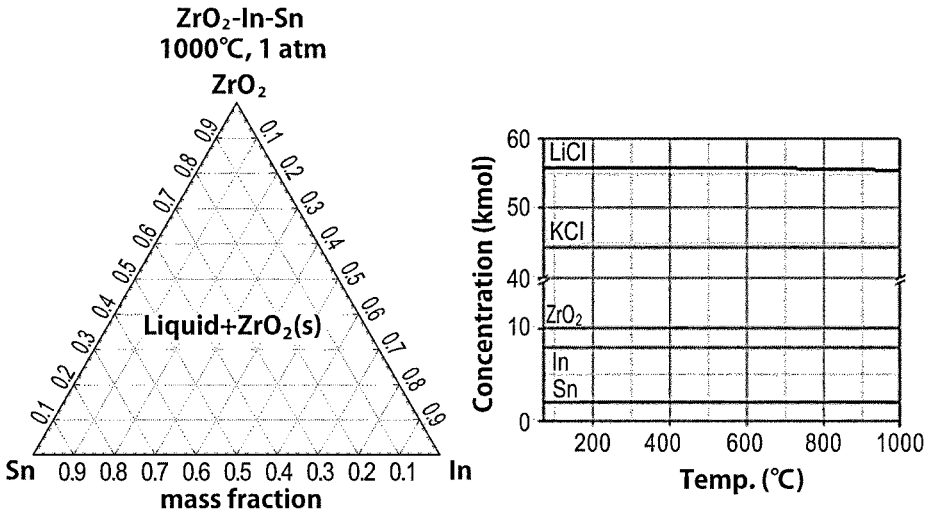
Figure 3E:
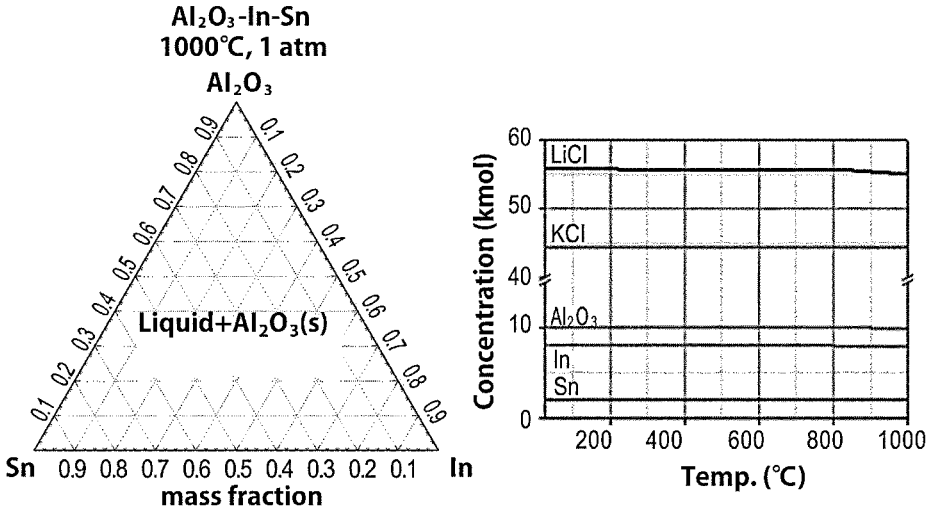

Further, as shown in FIGS. 3D and 3E, it can be confirmed that the ceramic material is thermodynamically stable in reaction with the liquid In—Sn metal and thus is usable as a crucible material.

Next, the evaluation of electrochemical properties for deriving the conditions of the molten-salt electrolytic refining process for In—Sn treatment will be described.

Figure 4:
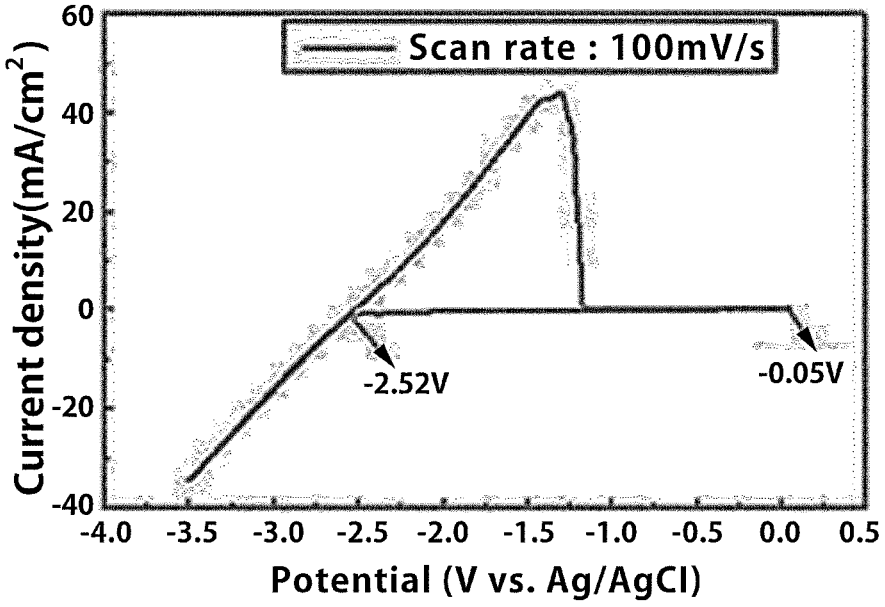
FIG. 4 shows the cyclic voltammetry measurement result of a LiCl—KCl eutectic salt.

In a cyclic voltammetry method, 721.39 g of LiCl—KCl (55.7-44.3 mol %, eutectic temperature: 355° C.) was used as an electrolyte, and crystal water in the sample was removed using a heat treatment process at 250° C. for about 20 hours before melting. During the experiment, the electrolyte was maintained at 450° C., and an $Al_2O_3$ crucible having a diameter of 100 mm and a height of 100 mm was used as the crucible. A Mo wire having a diameter of 0.5 mm was used as a working electrode, a tungsten rod having a diameter of 10 mm was used as a counter electrode, and Ag/AgCl was used as a reference electrode. It can be seen that the cyclic voltammetry (CV) scan rate is 100 mV/s, and the results of the experiment are shown in FIG. 4.

That is, the scan range of the LiCl—KCl eutectic salt blank CV ranged from −0.05 V to −3.5 V vs. Ag/AgCl, a peak electric current did not appear from −0.05 V to −2.5 V, and a high applied range of a cell potential of about 5 V or higher was secured.

Figure 5:
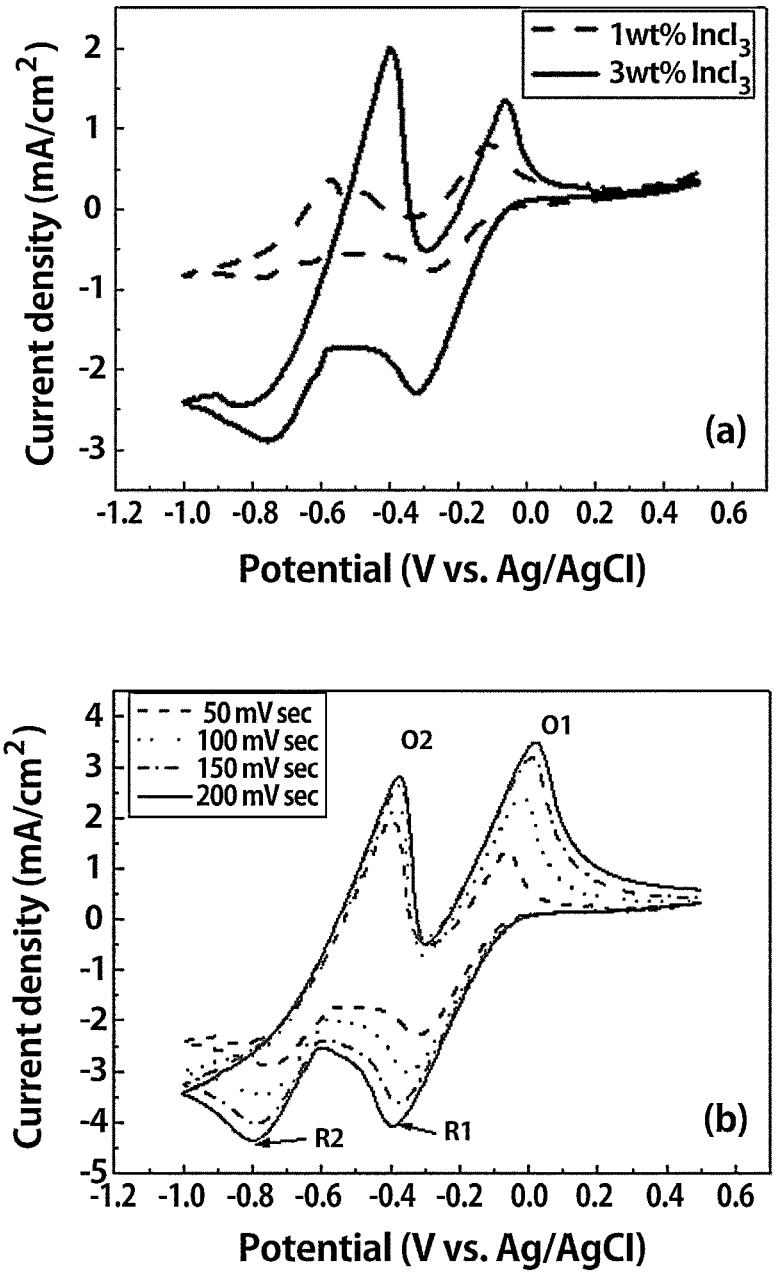
FIG. 5 shows the cyclic voltammetry measurement result of the LiCl—KCl eutectic salt to which an initiator is added.

In addition, FIG. 5A shows the CV test result after $InCl_3$ is added in an amount of 1 wt % and 3 wt % based on the amount of the electrolyte in the LiCl—KCl eutectic salt at 450° C. FIG. 5B shows the CV test result according to the scan rate after $InCl_3$ is added in an amount of 3 wt %.

As can be seen in FIGS. 5A and 5B, two pairs of redox reaction potentials were confirmed, and it can be seen that reduction reactions were observed at 0 V and −0.6 V vs. Ag/AgCl and that oxidation peaks corresponding thereto were also observed.

Further, it can be seen that the oxidation/reduction peak is slightly shifted toward the anode as the amount of $InCl_3$ added is increased, because the electrochemical activity of $In_3^+$ is increased as the concentration of $InCl_3$ is increased. This is due to the control of the electrode reaction by the movement of electrons. Moreover, it can be confirmed that the supply of electric current is increased as the concentration of $InCl_3$ is increased.

Meanwhile, the stability of the anode material and the initiator will be described. The In—Sn metal was charged into the anode for extraction of pure In. In order to increase the applied electric current in the chronopotentiometry (galvanostatic method) experiment, a molybdenum wire was replaced by a tungsten rod (W rod) in the case of the electrode of the anode.

As a result, it was confirmed that the color of the LiCl—KCl eutectic salt was changed to a pale yellow color after the In—Sn metal was charged, and yellow fumes were generated when $InCl_3$ was additionally charged.

Accordingly, thermodynamic calculations regarding the stability of $InCl_3$ and Sn, used as the initiator, were performed using HSC Chemistry. It can be seen that $InCl_3$ exists in the form of $In^{2+}$ and $In^{1+}$ as well as $In^{3+}$ in the LiCl—KCl eutectic salt and that $InCl_3$ does not thermodynamically react with the eutectic salt. It can also be seen that the amounts of $In^{3+}$ and $In^{2+}$ tend to increase by the decreased amount of $In^{2+}$ when the temperature is increased.

Figure 6:
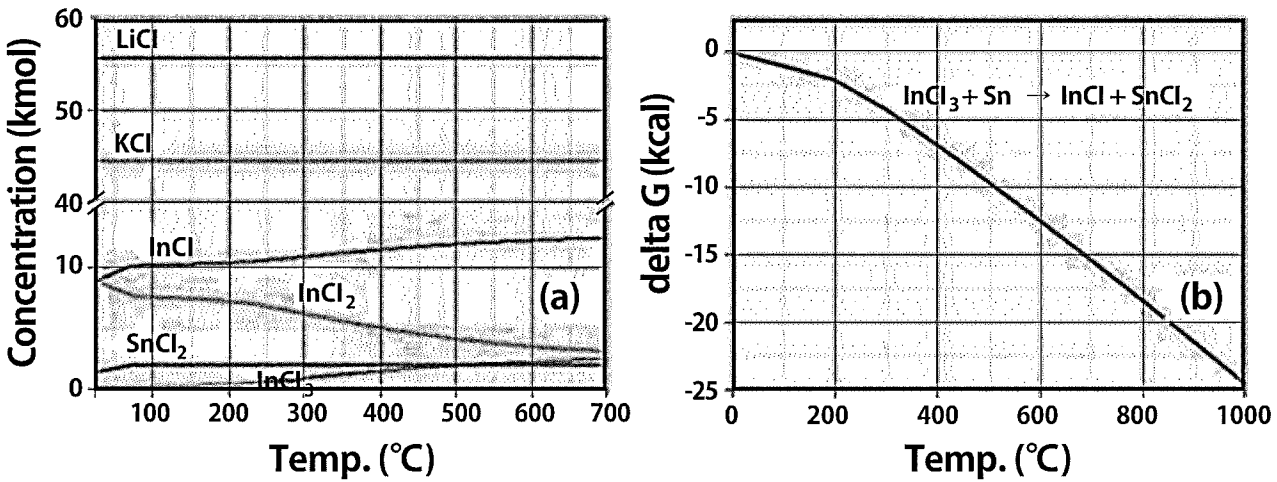
FIG. 6 shows the result of evaluation of the thermodynamic stability of an initiator and an anode material (Sn)

However, Sn, which is one element of the anode material, is reacted with $InCl_3$ to form $SnCl_2$. In this regard, as can be seen in FIG. 6B, it can be confirmed that the reaction occurs more actively as the process temperature is increased.

<Molten-Salt Electrolytic Refining Method>

Next, a procedure of performing an electrolytic refining process using a molten-salt electrolytic solution containing a fluoride in the molten-salt electrolytic refining apparatus having the above-described constitution will be described.

Figure 7:
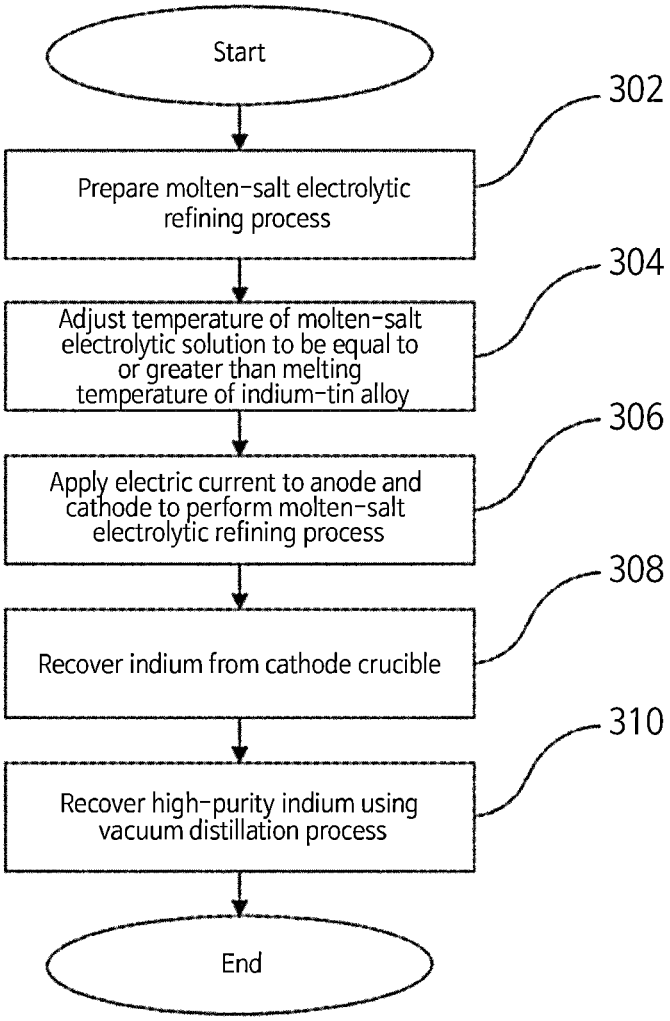
FIG. 7 is a flowchart showing a procedure for performing a molten-salt electrolytic refining process according to another embodiment of the present invention.

FIG. 7 is a flowchart showing a procedure for performing a molten-salt electrolytic refining process according to another embodiment of the present invention.

Referring to FIG. 7, in the molten-salt electrolytic refining method according to another embodiment of the present invention, indium (In) may be recovered from an indium-tin (In—Sn) alloy using a molten-salt electrolytic solution containing fluoride.

The procedure will be described step by step. The molten-salt electrolytic refining process may be prepared using a method that includes filling a reaction crucible 104 provided in a reaction container 102 with a molten-salt electrolytic solution (M.S.) containing the fluoride, immersing an anode 106 and a cathode 108 in the molten-salt electrolytic solution (M.S.), immersing the lower end of the anode 106 in an anode crucible 10 in which the liquid indium-tin (In—Sn) alloy to be refined is contained, and disposing a cathode crucible 112 in which the lower end of the cathode 108 is positioned at step 302.

For example, the anode crucible 110 charged with the indium-tin (In—Sn) alloy may be disposed in the reaction crucible 104 provided in the reaction container 102, and the cathode crucible 112 may be disposed adjacent thereto. After the interior of the reaction crucible 104 is filled to a predetermined level with the molten-salt electrolytic solution, sealing may be performed using the upper cover of the reaction container 102.

The fluoride may include lithium fluoride (LiF) and potassium fluoride (KF). A heat-blocking material 118 may be provided between the reaction container 102 and the heater 114, thus blocking the heat of the heater 114.

Further, the anode 106 and the cathode 108 may be immersed in the molten-salt electrolytic solution (M.S.) by lifting the holding plate 120 on which the reaction crucible 104 is seated. Each of the anode 106 and the cathode 108 may be manufactured using at least one selected from among tungsten (W), tantalum (Ta), and molybdenum (Mo). The raw-material alloy may be continuously supplied to the anode crucible 110 through the hollow portion in the anode 106.

Meanwhile, the reaction crucible 104 may be manufactured using nickel (Ni). The anode crucible 110 and the cathode crucible 112 may be manufactured using zirconium oxide ($ZrO_2$) or aluminum oxide ($Al_2O_3$).

The anode crucible 110 and the cathode crucible 112 may be respectively seated on a first support plate 122 and a second support plate 124 including a ceramic material containing aluminum oxide ($Al_2O_3$), thus being disposed in the reaction crucible 104.

In addition, the heater 114 may be operated so that the temperature of the molten-salt electrolytic solution (M.S.) is adjusted to be equal to or greater than the melting temperature of the indium-tin (In—Sn) alloy charged in the anode crucible 110 at step 304.

Next, an electric current may be applied to the anode 106 and the cathode 108 to perform the electrolytic refining process at step 306. For example, the holding plate 120 may be moved upwards so that the anode 106 and the cathode 108 are immersed in the molten-salt electrolytic solution (M.S.), thereby performing the electrolytic refining process.

Subsequently, indium (In) may be recovered from the cathode crucible 112 using the electrolytic refining process of step 306 at step 308. For example, liquid indium (In) may be recovered from the cathode crucible 112 using the electrolytic reduction reaction of the liquid indium-tin (In—Sn) alloy and the molten-salt electrolytic solution (M.S.).

In the molten-salt electrolytic refining method as described above, in order to continuously perform the electrolytic refining process using an electrolytic reduction reaction, the indium-tin (In—Sn) alloy may be continuously supplied in a liquid phase to the interior of the anode 106, and indium (In) may be continuously recovered from the cathode crucible 112 through the recovery unit 128 while the unreacted alloy remaining in the anode crucible 110 is continuously discharged through the discharge unit 126.

Meanwhile, high-purity indium (In) may be recovered by performing a vacuum distillation process on the recovered indium (In) at step 310. This step 310 may include a first step of removing at least one impurity having a saturation vapor pressure that is relatively higher than the saturation vapor pressure of the indium (In) using a first vacuum distillation process, and a second step of volatilizing the indium (In) using a second vacuum distillation process at a temperature relatively higher than in the first step, thus recovering the high-purity indium (In).

For example, among the residues remaining in the recovered indium (In), the residues (e.g., Cd, Zn, Tl, and Pb), having saturation vapor pressure higher than the saturation vapor pressure of the indium (In), may be vaporized first before the vaporization of the indium (In), thus being removed. In the case of other residue (e.g., Sn), having the saturation vapor pressure lower than the saturation vapor pressure of the indium (In), the indium (In) may be vaporized and separated first. Of course, most of the Sn is vaporized and removed in the first step. However, since the saturation vapor pressure thereof is lower than that of indium (In), a portion of the Sn remains, so the second step may be additionally performed to volatilize and collect the indium (In), thereby recovering high-purity indium (In).

The above-mentioned vacuum distillation process may be performed so that the number of processes and the processing time are adjusted depending on the separation coefficients corresponding to indium (In) and impurities.

Accordingly, in the present invention, the temperature of the molten-salt electrolytic solution may be adjusted to be equal to or greater than the melting temperature of the raw-material alloy using the heater provided between the reaction container and the reaction crucible, and electric current may be applied to the anode and the cathode to perform the electrolytic refining process. Thereby, the raw-material alloy containing indium may be refined using the molten-salt electrolytic refining method, thus effectively recovering high-purity indium.

Further, in the present invention, the electrolytic refining process may be performed using the fluoride containing lithium fluoride (LiF) and potassium fluoride (KF) as the molten-salt electrolytic solution. Accordingly, thermodynamic stability and reactivity may be improved, thus effectively recovering high-purity indium.

Moreover, during the electrolytic refining process, the liquid raw-material alloy may be continuously supplied through the hollow portion of the anode, and the raw-material alloy may be continuously recovered from the cathode crucible while the unreacted alloy is discharged from the anode crucible. Thereby, a continuous electrolytic refining process may be performed, thus effectively improving the process yield and productivity.

Next, the thermodynamic stability of tin (Sn), which is an anode material, and indium trichloride ($NiCl_3$), which is an initiator, will be described in the conventional case in which chlorides are used as the molten-salt electrolytic solution.

For the purpose of recovery of pure indium (In), the anode was charged with an indium-tin (In—Sn) metal. In order to increase the applied electric current in a chronopotentiometry (galvanostatic method) experiment, a molybdenum wire was replaced by a tungsten rod in the case of the electrode of the anode.

Figure 8:
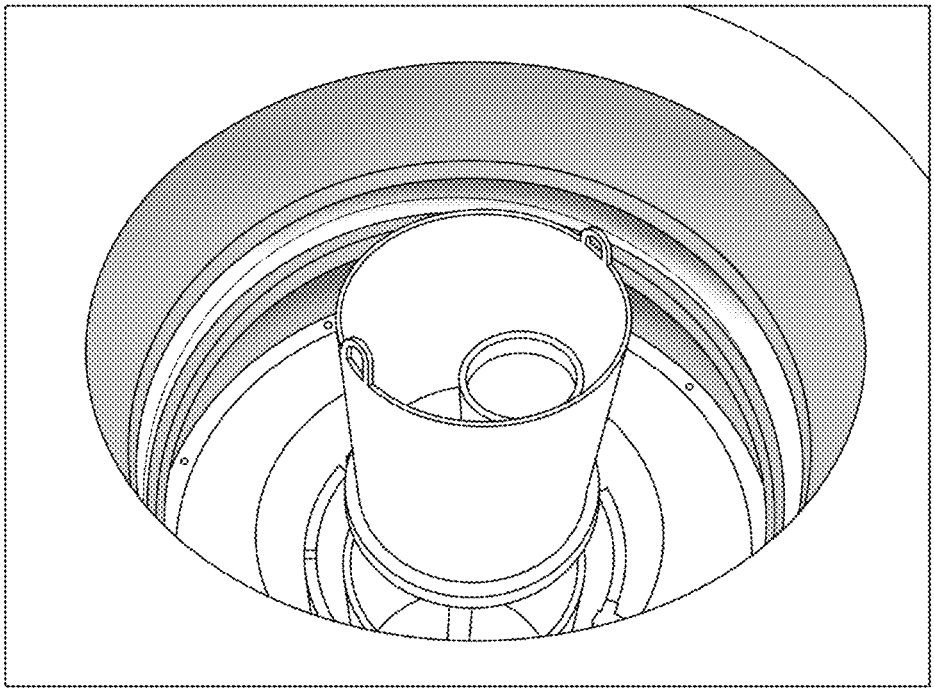
FIGS. 8 and 9 are views for explaining a conventional problem that occurs when a chloride is used as a molten-salt electrolytic solution.

As a result, when the indium-tin (In—Sn) alloy is introduced into chlorides (LiCl—KCl) used as the molten-salt electrolytic solution and $InCl_3$ used as the initiator, it could be confirmed that yellow fumes were generated, as shown in FIG. 8, thus contaminating the reactor. This was found to be due to the effect of AlOCl (g), formed by the reaction of $SnCl_4$ (g), $Al_2O_3$, and Cl ions. That is, it could be seen that $SnCl_2$ was formed by the reaction of $InCl_3$ and Sn metal and that $SnCl_2$ reacted even with a Ni crucible.

Meanwhile, thermodynamic calculations regarding the stability of $InCl_3$ and tin (Sn) used as the initiator were performed using HSC Chemistry. As shown in FIG. 6A, in the lithium chloride-potassium chloride (LiCl—KCl) eutectic salt, it could be seen that indium trichloride ($InCl_3$) exists in the form of $In^{2+}$ and $In^{1+}$ as well as $In^{3+}$ and does not thermodynamically react with the eutectic salt. It could also be seen that the amounts of $In^{3+}$ and $In^{1+}$ tend to increase by the decreased amount of $In^{2+}$ when the temperature is increased. However, tin (Sn), which is one element of the anode material, is reacted with indium trichloride ($InCl_3$) to form tin dichloride ($SnCl_2$). In this regard, as can be seen in FIG. 6B, it can be confirmed that the reaction occurs more actively as the process temperature is increased.

Figure 9:
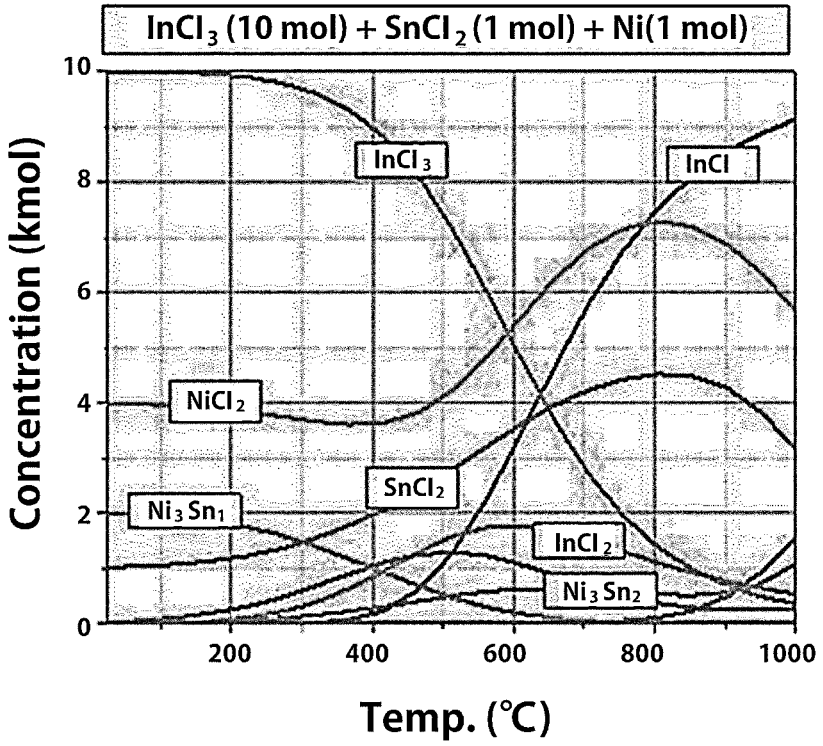

Further, as shown in FIG. 9, it can be seen that the concentration of indium chloride (InCl) is increased according to the reduction of indium trichloride ($InCl_3$). Since tin dichloride ($SnCl_2$) formed due to indium trichloride ($InCl_3$) is reacted with a nickel (Ni) crucible to form a nickel-tin (Ni—Sn) compound, it can be seen that nickel (Ni) and alumina crucibles are not suitable.

A major problem in refining indium (In) from indium-tin (In—Sn) metal has been identified, and accordingly, the suitability of the case where fluorides are used instead of chlorides as the molten-salt electrolytic solution will be described below.

Next, thermodynamic stability for optimal material selection of the electrode and the crucible when the fluoride is used as the molten-salt electrolytic solution in the molten-salt electrolytic refining apparatus and method having the above-described constitution will be described.

Figure 10:
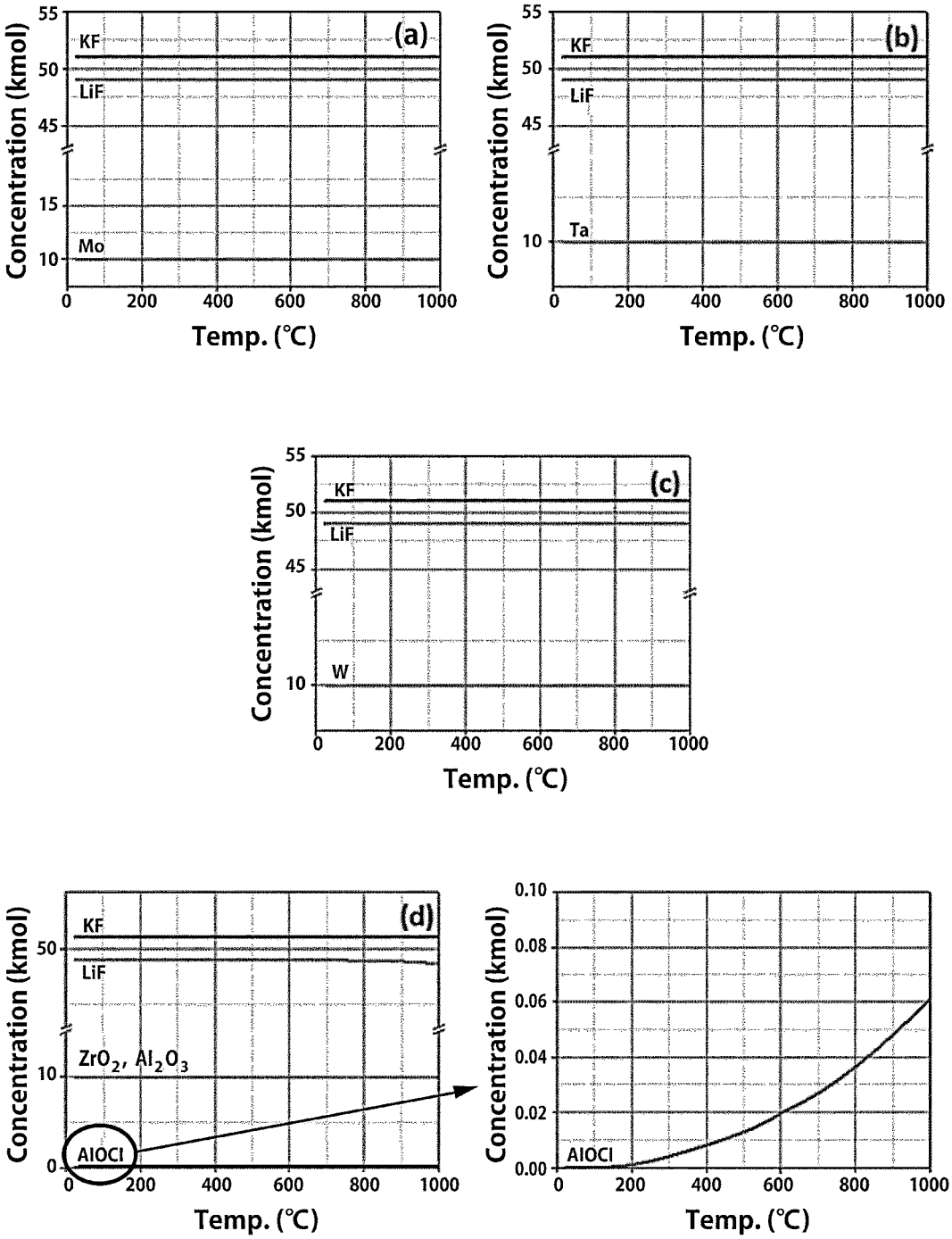
FIGS. 10 and 11 are views for explaining thermodynamic stability for optimal material selection of an electrode and a crucible when a fluoride is used as a molten-salt electrolytic solution according to an embodiment of the present invention.
Figure 11:
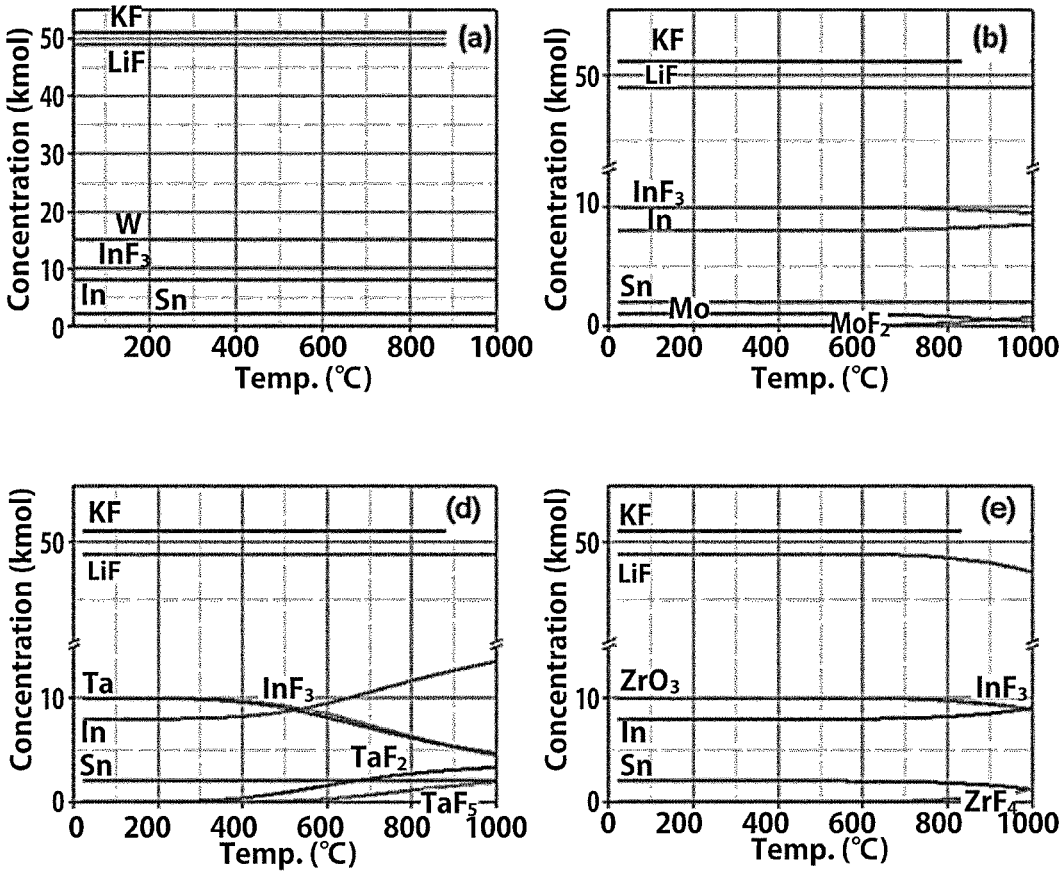

FIGS. 10 and 11 are views for explaining thermodynamic stability for optimal material selection of the electrode and the crucible when the fluoride is used as the molten-salt electrolytic solution according to the embodiment of the present invention.

The thermodynamic stability of the electrolyte, the electrode, and the crucible will be described with reference to FIG. 10. The eutectic salt of lithium fluoride (LiF) and potassium fluoride (KF) was selected as the electrolyte composition, and based thereon, HSC chemistry was used to evaluate the thermodynamic stability of the electrolyte/electrode material and the electrolyte/crucible.

It can be confirmed that the selected molybdenum, tantalum, and tungsten materials shown in FIGS. 10A to 10C do not react with the lithium fluoride-potassium fluoride (LiF—KF) eutectic salt and are thermodynamically stable. Accordingly, it is determined that all three metal materials are usable as crucible and electrode materials.

In addition, in order to confirm the possibility of the use of materials other than the metallic materials in the crucible, ceramic materials such as zirconium oxide ($ZrO_2$) and aluminum oxide ($Al_2O_3$) were also evaluated for stability with the lithium fluoride-potassium fluoride (LiF—KF) eutectic salt.

As shown in FIG. 10D, it can be confirmed that zirconium oxide ($ZrO_2$) does not react with the eutectic salt and is thermodynamically stable. However, it can be confirmed that aluminum oxide ($Al_2O_3$) forms a small amount of acid chlorides (AlOCl) as the temperature is increased. Accordingly, it can be determined that zirconium oxide ($ZrO_2$) is relatively more useful as a crucible material.

Meanwhile, the thermodynamic stability of the anode/cathode material/initiator ($InF_3$) and the electrode/crucible material will be described with reference to FIG. 11. The thermodynamic stability of each material and the indium-tin (In—Sn) metal used as the anode material was also determined.

In addition, the above-described materials are applicable only when thermodynamically stable with respect to indium fluoride ($InF_3$), used as the initiator. Accordingly, the thermodynamic stability between the anode/cathode material, the initiator, and each material was evaluated using HSC chemistry, and the results are shown herein.

As shown in FIG. 11, it can be seen that tungsten is a material that is very thermodynamically stable with respect to the indium-tin (In—Sn) metal, which is the anode material.

Further, it can be seen that indium fluoride ($InF_3$), which is used as the initiator, and tungsten do not cause any reaction, and remain very thermodynamically stable.

However, it can be confirmed that molybdenum (Mo) and tantalum (Ta) are reacted with indium fluoride ($InF_3$) to form $MoF_2$, $TaF_2$, and $TaF_3$ at about 400° C. and 700° C. In particular, it was confirmed that tantalum (Ta) forms fluorides at a relatively low temperature, and thus it is impossible to apply tantalum to an actual experiment.

Zirconium oxide ($ZrO_2$) forms zirconium fluoride ($ZrF_4$) at high temperatures, but it is determined that zirconium oxide is usable at process temperatures of about 800° C. or less.

Moreover, in the case of tungsten (W) and zirconium oxide ($ZrO_2$), when a fluoride-based initiator is used in the reaction with tin (Sn) as an anode material metal, which has been considered problematic when the chloride-based electrolyte and the initiator are used, a very stable phase is maintained. Accordingly, it can be seen that tungsten and zirconium oxide are applicable in practice.

Next, a procedure for deriving conditions for the vacuum distillation process for the removal of residual salts in an electrodeposited substance in the molten-salt electrolytic refining apparatus and method having the above-described constitution will be described.

FIGS. 12, 13, and 14 to 16 are views for explaining the vacuum distillation process that is additionally applied to the molten-salt electrolytic refining method according to the embodiment of the present invention. The procedure for deriving conditions of the vacuum distillation process for the removal of residual salts in the electrodeposited substance will be described below with reference to these drawings.

First, the saturation vapor pressure of the liquid metal may be calculated using the following Mathematical Equation 1.

$$\log(P^{*}\text{atm})=A+B/T+C\cdot\log T+D/T^{3} \quad \text{[Mathematical Equation 1]}$$

The possibility of vacuum distillation of indium (In) was analyzed through calculation of the saturation vapor pressure as described above. In order to remove the impurities and residual salts contained in a small amount in the indium (In) recovered using indium-tin (In—Sn) molten-salt electrolytic refining so as to obtain ultra-high-purity indium (In) metal, the possibility of performing further refining using vacuum distillation was analyzed.

This vacuum distillation is a refining process using the principle whereby the external pressure is increased until the external pressure reaches the saturation vapor pressure in order to achieve equilibrium between a liquid phase and a vapor phase when the saturation vapor pressure of a specific element is higher than the external pressure. It is possible to obtain high purity by volatilizing impurities having saturation vapor pressure higher than that of indium (In).

Therefore, since the saturation vapor pressures of indium (In) and the impurities are important, the saturation vapor pressures of (In)/(Impurities, such as Zn, Pb, and Sn, capable of remaining in In)/(Cd and Zn, which have electrical properties similar to those of In, and which were difficult to remove using molten salt refining) were calculated.

Figure 13:
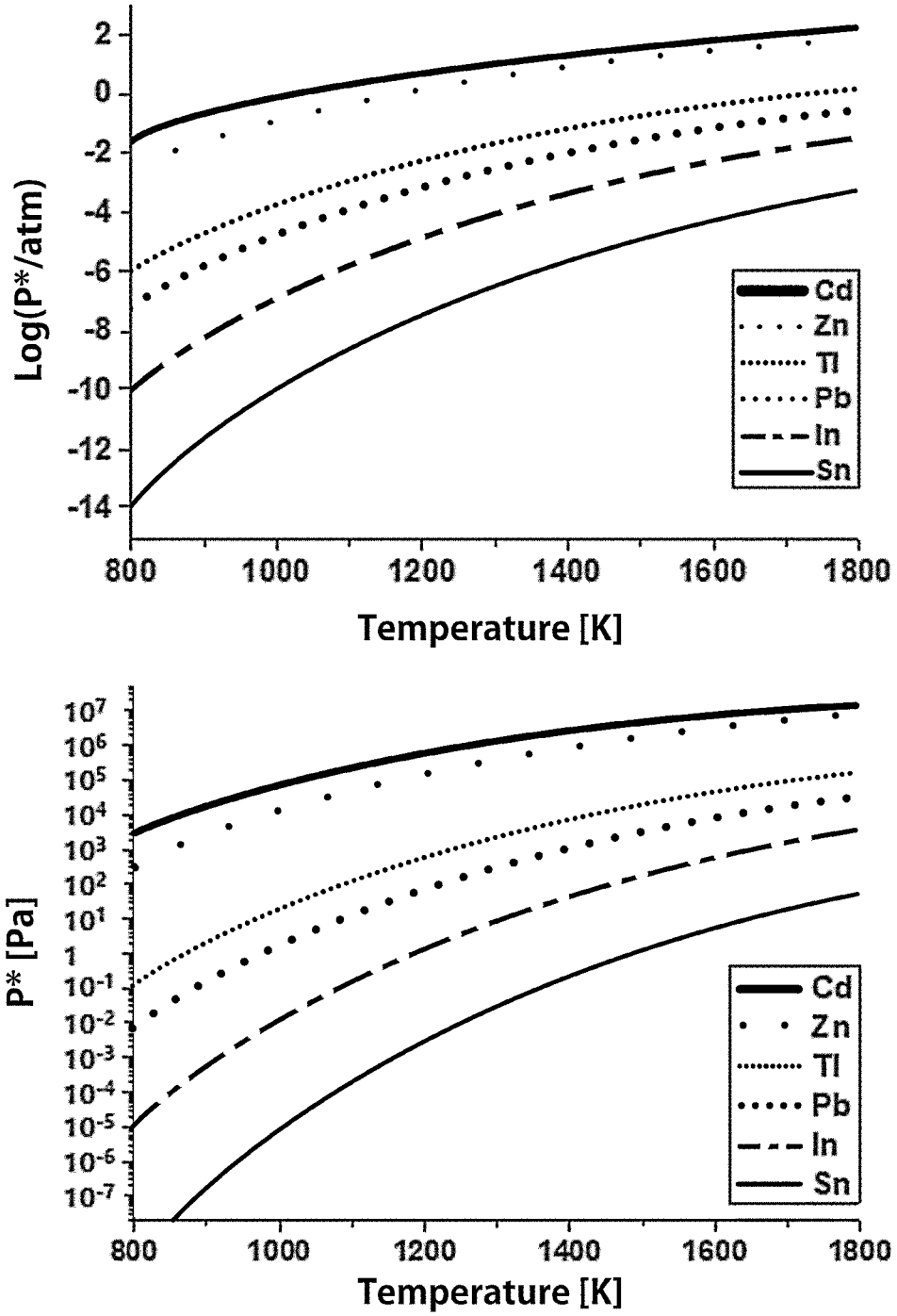

As a result of the above-described calculation of saturation vapor pressure, in FIGS. 12 and 13, the magnitude of the saturation vapor pressure is shown in the order of Cd, Zn, Tl, Pb, In, and Sn. It can be confirmed that Cd, Zn, Tl, and Pb, which have saturation vapor pressure higher than the saturation vapor pressure of In, are capable of being removed by vaporizing Cd, Zn, Tl, and Pb before the vaporization of In, and that Sn, having saturation vapor pressure lower than the saturation vapor pressure of In, is capable of being separated by vaporizing In.

Further, it can be seen that Cd and Tl, which have electrical properties similar to those of indium (In) and thus are difficult to remove using electrolytic refining, are capable of being easily removed using vacuum distillation.

Figure 14:
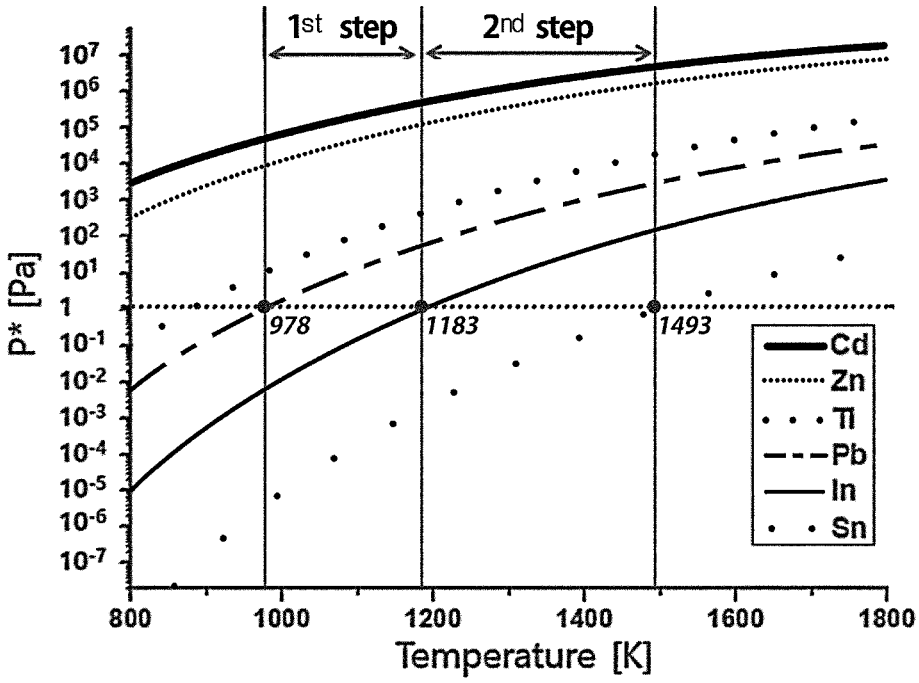
Figure 14:
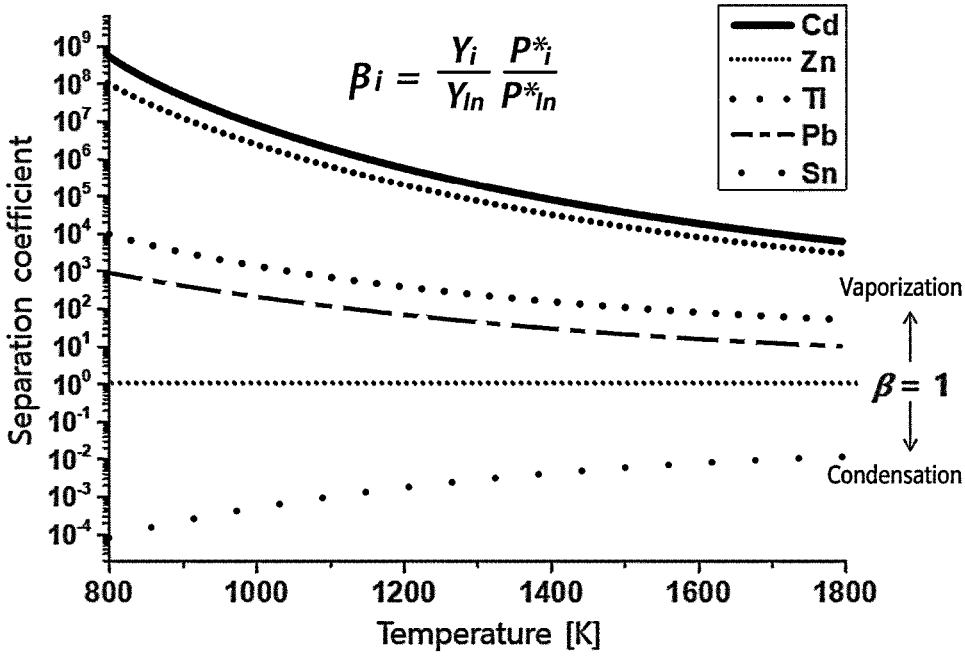

The procedure for deriving the conditions of the vacuum distillation process as described above will be described. As shown in FIG. 14, high-purity indium (In) may be recovered using a two-step vacuum distillation process for refining indium (In) based on the calculated saturation vapor pressure. In a first step, elements having a saturation vapor pressure higher than that of indium (In) may be removed by vaporization. In a second step, the indium (In) may be volatilized at a temperature relatively higher than in the first step, thus recovering high-purity indium (In). Elements having saturation vapor pressure lower than that of indium (In) may be condensed into a liquid.

In the vacuum distillation process, the strength of the formed vacuum is important. Manufacturing costs are increased due to an increase in apparatus and processing costs when a strong vacuum is created, so vacuum distillation may be performed under a low vacuum condition.

A rotary pump may be used in order to create the low vacuum, and a vacuum strength of about 1 Pa may be obtained during evacuation for the vacuum using the rotary pump.

For example, when the rotary pump is operated so as to obtain a vacuum strength of $10^{-2}$ to $10^{-3}$ torr (0.133322 to 1.33322 Pa, 1 torr=133.322 Pa), so when the pressure in the vacuum distillation process is set to 1 Pa (approximately $7.5\times10^{-3}$ torr), in the case of deriving the process condition based on 1 Pa, the saturation vapor pressure reaches 1 Pa at 978K in the case of Pb, and the saturation vapor pressure reaches 1 Pa at 1183K in the case of indium (In). When heating is performed to a temperature of 978K to 1183K, since Cd, Zn, Tl, and Pb are vaporized but indium (In) is not vaporized, the impurities may be removed during the first step.

After the impurities are removed during the first step as described above, only indium (In) and Sn remain. When heating is performed to 1183K to 1493K, at which the saturation vapor pressure of Sn reaches 1 Pa, indium (In) is vaporized and Sn is condensed into a liquid phase. Accordingly, the vaporized indium (In) may be collected to recover high-purity indium (In).

The vaporization efficiency of the impurities in the liquid phase of indium (In) may be analyzed using a separation coefficient, which is the ratio of impurities and indium (In) (activity coefficient×saturation vapor pressure). When the separation coefficient is more than 1, vaporization occurs effectively, and when the separation coefficient is less than 1, condensation into a liquid phase occurs. As the absolute value thereof is increased, vaporization and condensation efficiencies may be increased, and the vaporization coefficients of all elements come close to 1 as the temperature is increased. Accordingly, it is necessary to determine the optimum temperature condition for the vacuum distillation process.

For example, the vaporization of pure metal is affected only by the saturation vapor pressure (P*), but vaporization in the alloy is affected even by activity between atoms. Accordingly, the separation coefficient (β) may be represented by the following Mathematical Equation 2.

$$\beta_i = \frac{\gamma_i}{\gamma_{In}} \frac{P_i^*}{P_{In}^*} \quad \text{[Mathematical Equation 2]}$$

γ is an activity coefficient. Since a dilute solution contains impurities in a small amount, an indium (In) molar fraction ($X_{In}$) is 1 and an impurity (i) molar fraction ($X_i$) is 0, so $\gamma_{In}$ may be assumed to be 1. When $\beta_i$ is more than 1, the impurities i may be vaporized and indium (In) may be condensed into a liquid phase. When $\beta_i$ is less than 1, indium (In) may be vaporized and the impurity i may be condensed into the liquid phase.

In addition, the calculation of the liquid-gas equilibrium diagram of the impurity will be described with reference to FIGS. 15 and 16. The liquid-gas equilibrium diagram (liquid-vapor phase diagram) is a diagram showing the equilibrium fractions at which impurities are present in a liquid phase and a gas phase. The removal efficiency according to the impurity content may be analyzed to determine the appropriate content of the impurity that is easy to remove. For the purpose of calculation of the equilibrium diagram according to the content of the impurity, it is necessary to change the activity coefficient according to the content of the impurity in indium (In). Accordingly, the activity coefficients of In—Cd, In—Zn, and In—Pb were calculated, and the resultant phase diagram thereof was derived.

Figure 15:
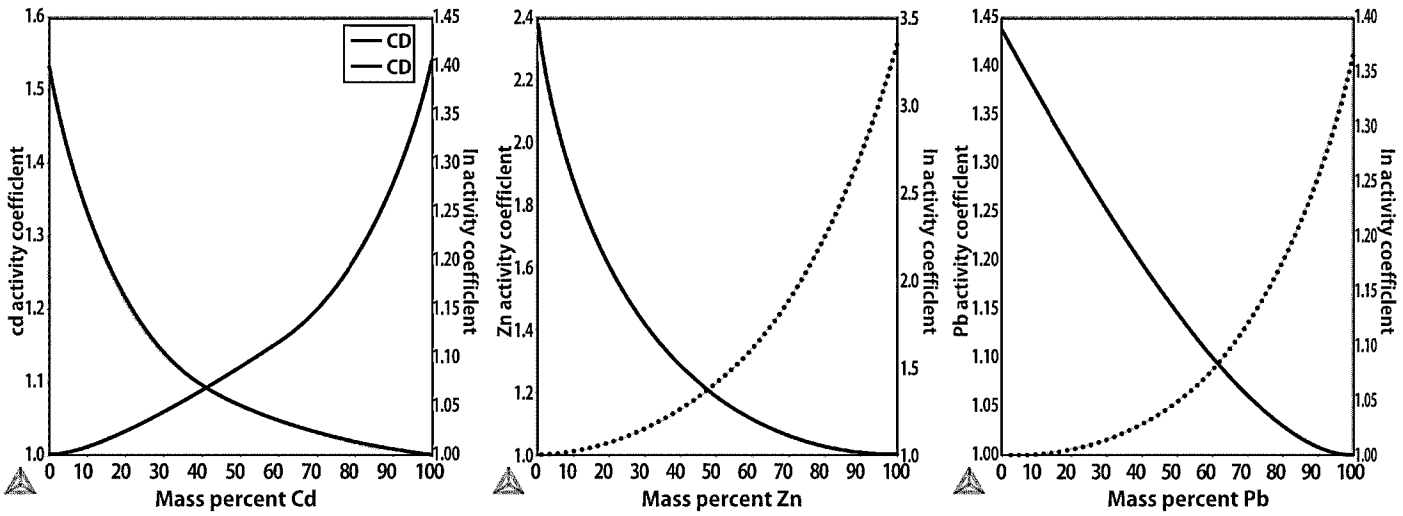

From the activity coefficients shown in FIG. 15, it can be seen that the activity coefficient is 1.54 when Cd is present in a very small amount in indium (In), as shown in the phase diagram, and that the activity coefficient is 2.39 and 1.43 when Zn and Pb are present in very small amounts. It can also be seen that three elements have a strong propensity for vaporization because all activity coefficients of the three elements are higher than 1 in indium (In).

Further, the liquid-gas equilibrium diagram (liquid-vapor phase diagram) for analyzing the removal efficiency according to the impurity content to thus determine the appropriate content of the impurity that is easy to remove may be represented by the following Mathematical Equation 3.

$$m_{Ag} = \left[1 + \left[\left(\frac{M_B}{M_A}\right)\cdot\left(\frac{a_B}{a_A}\right)\cdot\left(\frac{p_B^*}{p_A^*}\right)\right]\right]^{-1} \quad \text{[Mathematical Equation 3]}$$

$m_{Ag}$ means a mass fraction of A in a gas phase, $M_A$ means a molar mass of A, $a_A$ means an activity coefficient of A, and $P_A$ means a saturation vapor pressure of A.

Figure 16:
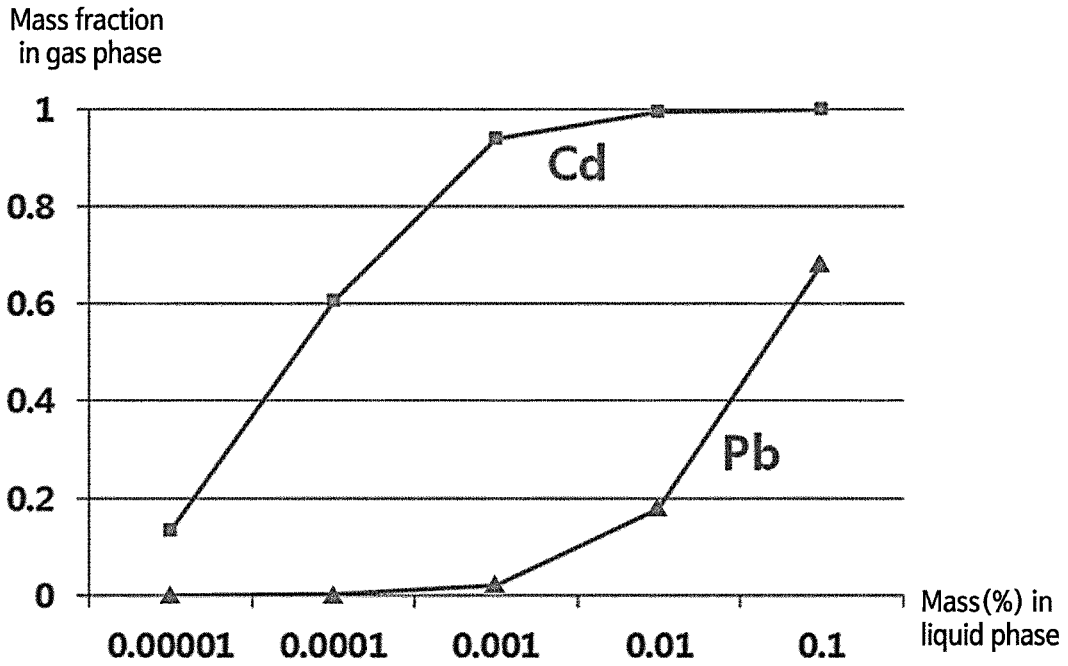

A liquid-gas equilibrium diagram of Cd and Pb at 1100K, at which the above-described one-step vacuum distillation is feasible, will be analyzed with reference to FIG. 16. In the case of Cd, when the content thereof in the liquid phase is 0.001%, the equilibrium content in the gas phase is 95%, and even a very small amount of Cd may be effectively removed. From the phase diagram, it can be seen that a very small amount of Pb may be removed but that the removal efficiency thereof is relatively lower than in the case of Cd. The horizontal axis is the mass (%) of each component in the liquid phase, and the vertical axis is the mass fraction of each component in the gas phase.

As described above, in order to remove the impurity contained in any one material (for example, indium), the liquid-gas equilibrium diagram (liquid-vapor phase diagram) using the activity coefficient and saturation vapor pressure corresponding to each component may be calculated, thereby adjusting the number of vacuum distillation processes and the processing time thereof. That is, the vacuum distillation process described above may be performed in the state in which the number of processes and the processing time are adjusted according to the separation coefficients corresponding to indium (In) and each of the impurities.

INDUSTRIAL APPLICABILITY

Although various embodiments of the present invention have been described for illustrative purposes, the present invention is not necessarily limited thereto, and those skilled in the art will easily appreciate that various substitutions, modifications, and changes are possible, without departing from the technical spirit of the present invention.

DESCRIPTION OF THE REFERENCE NUMERALS

| | | | |
|---|---|---|---|
| 102: | Reaction container | 104: | Reaction crucible |
| 106: | Anode | 108: | Cathode |
| 110: | Anode crucible | 112: | Cathode crucible |
| 114: | Heater | 116: | Reference electrode |
| 118: | Heat-blocking material | 120: | Holding plate |
| 122: | First support plate | 124: | Second support plate |
| 126: | Discharge unit | 128: | Recovery unit |

The invention claimed is:

1. A molten-salt electrolytic refining apparatus comprising:

a reaction container having a hollow portion therein and an upper cover provided at an opened top portion thereof to be sealed;

a reaction crucible provided in the reaction container so as to be filled with a molten-salt electrolytic solution;

an anode and a cathode immersed in the molten-salt electrolytic solution;

an anode crucible in which a raw-material alloy is contained so that a lower end of the anode is immersed in a liquid raw-material alloy to be refined;

a cathode crucible in which a lower end of the cathode is positioned so that at least one raw-material metal included in the raw-material alloy is recovered in a liquid phase through an electrolytic refining process;

a heater provided between the reaction container and the reaction crucible so that a temperature of the molten-salt electrolytic solution is adjusted to be equal to or greater than a melting temperature of the raw-material alloy; and a holding plate on which the reaction crucible is seated, wherein an electrolytic refining process is performed when the holding plate is moved upwards so as to bring a molten-salt electrolytic solution into contact with an anode and a cathode, and the electrolytic refining process is stopped when the holding plate is moved downwards so as to enable the molten-salt electrolytic solution to be spaced apart from the anode and the cathode.

2. The molten-salt electrolytic refining apparatus of claim 1, wherein an electrolytic refining process is performed when an anode and a cathode are moved downwards so as to be brought into contact with a molten-salt electrolytic solution, and the electrolytic refining process is stopped when the anode and the cathode are moved upwards so as to be spaced apart from the molten-salt electrolytic solution.

3. The molten-salt electrolytic refining apparatus of claim 1, wherein the anode includes a hollow portion therein, and the raw-material metal is continuously supplied in the liquid phase through the hollow portion to the anode crucible.

4. The molten-salt electrolytic refining apparatus of claim 1, further comprising:

a discharge unit for discharging an unreacted alloy remaining in the anode crucible; and a recovery unit for recovering the raw-material metal from the cathode crucible.

5. The molten-salt electrolytic refining apparatus of claim 1, wherein an indium-tin (In—Sn) alloy is charged as the raw-material alloy and indium (In) is recovered as the raw-material metal.

6. A molten-salt electrolytic refining method comprising:

recovering indium (In) from an indium-tin (In—Sn) alloy using a molten-salt electrolytic solution containing a fluoride, filling a reaction crucible provided in a reaction container with the molten-salt electrolytic solution, immersing an anode and a cathode in the molten-salt electrolytic solution, immersing a lower end of the anode in an anode crucible in which the liquid indium-tin (In—Sn) alloy is contained, and disposing a cathode crucible in which a lower end of the cathode is positioned;

adjusting a temperature of the molten-salt electrolytic solution to be equal to or greater than a melting temperature of the indium-tin (In—Sn) alloy using a heater provided between the reaction container and the reaction crucible;

applying an electric current to the anode and cathode, thus performing an electrolytic refining process; and recovering the indium (In) from the cathode crucible using the electrolytic refining process, wherein the reaction crucible is seated on a holding plate, wherein the electrolytic refining process is performed when the holding plate is moved upwards so as to bring the molten-salt electrolytic solution into contact withe the anode and the cathode, and the electrolytic refining process is stopped when the holding plate is moved downwards so as to enable the molten-salt electrolytic solution to be spaced apart from the anode and the cathode.

7. The molten-salt electrolytic refining method of claim 6, wherein the fluoride includes lithium fluoride (LiF) and potassium fluoride (KF).

8. The molten-salt electrolytic refining method of claim 6, wherein the indium-tin (In—Sn) alloy is continuously supplied through a hollow portion in the anode to the anode crucible.

9. The molten-salt electrolytic refining method of claim 6, wherein the molten-salt electrolytic refining method is continuously performed in such a way that the indium (In) is recovered from the cathode crucible while an unreacted alloy remaining in the anode crucible is discharged.

10. The molten-salt electrolytic refining method of claim 6, further comprising:

performing a vacuum distillation process on the recovered indium (In).

11. The molten-salt electrolytic refining method of claim 10, wherein the performing the vacuum distillation process includes:

a first step of removing at least one impurity having a saturation vapor pressure that is relatively higher than a saturation vapor pressure of the indium (In) using a first vacuum distillation process in a predetermined temperature range; and a second step of volatilizing the indium (In) using a second vacuum distillation process in a temperature range relatively higher than in the first step, thus recovering high-purity indium (In).

* * * * *